US010135190B2

(12) United States Patent
Bozikis

(10) Patent No.: US 10,135,190 B2
(45) **Date of Patent: *Nov. 20, 2018**

(54) ELECTRICAL PLUG AND SOCKET SECUREMENT SYSTEM

(71) Applicant: Vaios Nikolaos Bozikis, Moraga, CA (US)

(72) Inventor: Vaios Nikolaos Bozikis, Moraga, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/607,643

(22) Filed: May 29, 2017

(65) Prior Publication Data

US 2017/0331225 A1 Nov. 16, 2017

Related U.S. Application Data

(63) Continuation-in-part of application No. 15/441,228, filed on Feb. 23, 2017, which is a continuation-in-part of application No. 14/450,303, filed on Aug. 4, 2014, now Pat. No. 9,583,878.

(51) Int. Cl.
*H01R 13/62* (2006.01)
*H01R 13/639* (2006.01)

(52) U.S. Cl.
CPC ..... *H01R 13/6392* (2013.01)

(58) Field of Classification Search
CPC ..... H01R 13/6392; H01R 13/639; H01R 13/6271; H01R 13/6272; H01R 13/6273; H01R 43/26
USPC ..... 439/369, 345, 296, 144
See application file for complete search history.

(56) References Cited

U.S. PATENT DOCUMENTS

| | | | | |
|---|---|---|---|---|
| 3,014,194 | A | 12/1961 | Na | |
| 3,985,415 | A | 10/1976 | Wolpert | |
| 4,085,991 | A | 4/1978 | Marshal | |
| 4,143,934 | A | 3/1979 | Siebert | |
| 4,643,505 | A | 2/1987 | House et al. | |
| 4,925,396 | A | 5/1990 | Grover | |
| 4,954,097 | A | 9/1990 | Sekiguchi | |
| 5,129,839 | A | 7/1992 | VanSkiver | |
| 5,135,409 | A | 8/1992 | Thompson | |
| 5,154,626 | A | 10/1992 | Watson | |
| 5,393,243 | A | 2/1995 | Carmo | |
| 5,507,664 | A | 4/1996 | Carmo | |
| 5,573,420 | A | 11/1996 | Grosswendt | |
| 5,820,398 | A | 10/1998 | Stabroth et al. | |
| 5,830,000 | A | 11/1998 | Shifflett et al. | |
| 6,056,557 | A | 5/2000 | Crotzer et al. | |
| 6,080,004 | A | 6/2000 | Kovacik et al. | |
| 7,182,624 | B1 * | 2/2007 | Miller | H01R 13/6392 439/369 |
| 7,347,708 | B1 | 3/2008 | Huang | |

(Continued)

*Primary Examiner* — Vanessa Girardi
(74) *Attorney, Agent, or Firm* — S. Elizabeth Miller

(57) ABSTRACT

An electrical plug fastener or retention mechanism comprising a system of binding or securing electrical plugs or other connectors to avoid unintentional or accidental disconnection. The retention mechanism comprises a base for connecting to a first cord and a clamp for connecting to a second cord. The clamp and base may be connected via at least one extension bar. The base may be two separate halves with means for connecting to one of the power cords and the clamp may comprise a fixed half and a moveable half enabled to lock to the fixed half.

18 Claims, 18 Drawing Sheets

(56) References Cited

U.S. PATENT DOCUMENTS

| | | | |
|---|---|---|---|
| 8,215,977 | B2 | 7/2012 | Zapf |
| 8,287,292 | B2 | 10/2012 | Byrne |

* cited by examiner

ELECTRICAL PLUG AND SOCKET SECUREMENT SYSTEM

This application is a continuation-in-part of U.S. patent application Ser. No. 15/441,228, filed on Feb. 23, 2017, which is a continuation-in-part of U.S. patent application Ser. No. 14/450,303, filed on Aug. 4, 2014, now U.S. Pat. No. 9,583,878. Each of these applications are hereby incorporated by reference herein in their entirety including the drawings.

FIELD OF INVENTION

The field of invention is electrical devices, plugs, retention mechanisms, securement systems, clamps, locks or fasteners, more specifically electrical devices or electrical plugs that prevent unintentional disconnection with a clamp, lock or fastener.

In the field of electric devices and power cords there are many devices such as electric mowers, weed whackers, brush saws, masonry saws, power drills, etc. These devices requite power from an electrical outlet by way of an electrical cord. A typical three pronged 120 volt alternating current (AC) plug (male) is attached by power cord to a device requiring power. A power cord is used to connect the male plug on the device to an outlet requiring that a female plug be connected to the male cord on the device. In some cases, where the device must be used further away from an outlet another cord (extension) may be required to allow for the distance. At each connection toward the outlet, a male and female three-pronged plugs are conjoined. It is important both for work and safety perspectives that the plugged connection remain connected, however, too often plugs may accidentally be disconnected immediately cutting power from a device being used and possible leading to an injury.

BACKGROUND OF THE INVENTION

The present invention relates to a device, fastener, lock, retention mechanism, or clamp for preventing electrical plugs from becoming unintentionally disconnected. Electrical plugs often become unintentionally disconnected when powering mobile equipment, including but not limited to, power tools and outdoor lawn maintenance equipment.

The inventor knows of a mechanism by which two conjoining plugs may be clamped together, which is described in a U.S. patent application Ser. No. 14/450,303, filed on Aug. 4, 2014, the disclosure of which is incorporated in its entirety by reference. Ser. No. 14/450,303 references a plug securing system that utilizes a base cylinder that may fit over the power cord on one side (powered device) of a cord plug connection, and a cord clamp on the opposite side (power cord to outlet) of the connection. The base cylinder of the system is attached to the cord clamp via a pair of extensions or bars.

The base cylinder of the mechanism may be physically positioned close to or immediately adjacent to the male plug on the device cord whereby the opposite end of the device may be swung up into a position to effect clamping over the power cord presenting the female plug. The inventor knows of a few differing implementations of the securing mechanism, but a challenge with the system is that it may be difficult to adjust it to a correct distance for securing the plugs together in a manner that they could not still be compromised. Therefore, what is clearly needed is a plug connection securing apparatus that may be adjusted on both sides of the plug connection and that may be implemented onto a connection with less work by the user.

SUMMARY OF INVENTION

A purpose of the devices and securement systems described herein is to prevent unintentional separation of two connectors, each of which is attached to a cord. The devices also allow a secure connection between connectors, which remain connected even under significant amounts of force. The devices and securement systems described herein fasten the two connectors together so that accidental disconnection does not occur.

A connector or connecters may be mean any connector, including, but not limited to, plug, socket, jack, electrical plug, electrical connector, cable connecter, male plug, female plug, hermaphrodite connector, video connector, audio connector, pin header connecter, temporary connector, RCA connecter, mount, ethernet connector, electrical power connector, USB connector, power connector, DC connector, phone connector, hybrid connecter, adapter, clip, modular connector, or any other connector know in the art.

A cord or cords may mean any cord or cable, including, but not limited to, electrical cord, power cord, electrical cable, ethernet cord, audio cable, video cable, extension cord, or any other cord or cable known in the art.

Another purpose of the devices and securement systems described herein is primarily to prevent unintentional separation of disconnectable electrical plugs that connect to electrically powered devices or power cords. The devices and securement systems described herein fasten electrical plugs together so that accidental disconnection does not occur. Each device is designed to secure the electrical plugs together in a manner such that they will remain connected until intentionally disconnected. The devices also allow a secure connection between electrical plugs, which remain connected even under significant amounts of force. The devices may be easily engaged or disengaged, yet when engaged, the connection is secure.

Another advantage of the devices and securement systems and described herein is that the systems can be used with connectors and plugs of varying shapes and sizes, so that specially designed plugs are unnecessary for the device to operate. Thus, the securement systems and devices described herein can be used to facilitate and maintain connections between any standard plugs or connectors, and many non-standard plugs or connectors.

Securement system is sometimes referred to herein as a system of securing a connector, or simply a device.

A first side, comprises a base. The base may be any type of hollow base that allows a cord to run through an opening in the middle. Herein, a base may be called a tubular base, a screw base, or a twisting base, as described in further detail herein. The first side can be used interchangeably with any base.

An additional embodiment is disclosed including an electrical connection secure clamp system, comprising a base having a length and a diameter securely connected around a first electrical cord, at least one extension bar, one end rotatably attached to a receptacle on one side of the base and a distal end extending past the first connector and a second connector, enabled to securely attach to a clamp secured around a second power cord attached to the second connector. The extension bar and clamp enabling locking the connectors in an engaged position or disengaging the distal end from the clamp, enabling translation of the extension bar allowing disengagement of the connectors from an engaged position.

The base may be cylindrical, surrounding the first power cord just behind the first connector and includes a locking assembly. The locking assembly may comprise a linear tooth array on an outside surface of the base, aligned with a longitudinal center of the base, an open ended cylindrical jacket installed over the base by fitting the base into a cutout in the jacket. In this embodiment the extension bar is rotatably attached to a receptacle on the jacket, and the jacket is tapered in a direction of the first power cord. The jacket also has at least one groove on an inside surface accommodating one or more teeth arranged parallel with and opposite to the linear tooth array.

A thread nut is provided having threads on an inner surface matching threads on an outer surface of the jacket, wherein the thread nut moves up the threads of the jacket towards the first connector creating pressure enabling engagement between the linear tooth array and the one or more teeth, thereby locking the jacket in place.

The clamp, in this embodiment, may include a moveable half and a fixed half fabricated from a tensile material, the fixed half forming a semi-circle with a first and second end. The extension bar may connect to the fixed half, and the moveable half may connect to the fixed half via a hinge at the first end and a lock and release at the second end. The moveable half may lift off of the fixed half from the second end creating an opening to receive the second power cord enabling the moveable half to close on the second power cord and lock.

In one embodiment, the moveable half consists of a clamp bar, the clamp bar may include a distal threaded end incorporating a threaded nut enabled to translate up and down the threaded end. The threaded nut may have two opposing pins that engage opposing pin receptacles at two spherical ends of a lever enabling the lever to rotate about the pins and translate up and down the threads at the threaded end thereby enabling accommodation of different sized second power cords.

In this embodiment, the fixed half also includes two divots at an outside edge of the semi-circle below the second end. The divots may be positioned to accept the spherical ends of the lever in a closed position and the pin receptacles are offset from a center of the two spherical ends away from a surface of the two spherical ends that engage the divots. With this arrangement, as the lever is pulled down in a closed position against the fixed half, an amount of pressure against the divots increases reaching a maximum amount of pressure immediately before the clamp is fully closed decreasing the distance between the first end and the second end of the fixed half thereby securely locking the clamp bar in place over the second power cord.

An additional embodiment provides that the moveable half may comprise a loop having two ends attached, one end each, at opposing sides of a lever connected at a base end to the second end of the fixed half via a hinge. The loop may be enabled to engage one of a plurality of anchor points fixedly attached to the outside edge of the fixed half in a linear array, thereby replacing position of the divots in the previous embodiment. After engagement of the loop with one of the anchors, the lever is pushed down applying a maximum amount of pressure against the power cord immediately prior to the lever closing in a locked position, thereby decreasing a dimension between the first and second ends of the fixed half. One with skill in the art understands that selection of an anchor to engage the loop defines a size of power cord that is secured within the fixed half.

In most embodiments presented, herein, an additional extension bar may be attached at a second receptacle on an opposing side of the jacket, the additional extension bar enabled to fixedly attach to the fixed half of the clamp.

In one embodiment, a clamp is provided including a fixed half and a moveable half fabricated from a tensile material, the fixed half forming a semi-circle with a first and second end creating an opening for accepting a power cord next to a first electrical connector. At least one extension bar is provided having one bar end fixedly connected to one side of the fixed half and a second distal bar end may extend past a second electrical connector and may rotatably attached to a receptacle on one of two opposing sides of a base surrounding a second power cord connected to the second electrical connector.

With this embodiment, the base is comprised of two equal opposing sides with means to connect the bases together around the second power cord forming a cylinder having a circular cylinder base. In additional embodiment, the two cylinder bases are ellipses and the means for connection enables tightening of the two sides around a variety of power cords having a smaller circumference than the cylinder having circular bases. Additionally, a second extension bar is may be rotatably attached at a second distal end to a second one of the two opposing sides and fixedly attached at a second bar end at a second side of the fixed half opposite the one side.

In this embodiment, the moveable half connects to the fixed half via a hinge at the first end and a lock and release at the second end, wherein the moveable half lifts off of the fixed half from the second end creating an opening to receive the second power cord enabling the moveable half to close on the second power cord and lock. An additional aspect of this embodiment may include a clamp bar fixed to the moveable half at one end, the clamp bar including a distal threaded end incorporating a threaded nut enabled to translate up and down the threaded end, the threaded nut having two opposing pins that engage opposing pin receptacles at two spherical ends of a lever enabling the lever to rotate about the pins and translate up and down the threads at the threaded end thereby enabling accommodation of different sized second power cords.

Additionally, in this embodiment, the fixed half includes two divots at an outside edge of the semi-circle below the second end, the divots may be positioned to accept the spherical ends of the lever in a closed position and the pin receptacles are offset from a center of the two spherical ends away from a surface of the two spherical ends that engage the divots, wherein as the lever is pulled down in a closed position against the fixed half, an amount of pressure against the divots increases reaching a maximum amount of pressure immediately before the clamp is fully closed decreasing the distance between the first end and the second end of the fixed half thereby securely locking the clamp bar in place over the second power cord.

In yet another embodiment a secure clamp system is provided that may include a clamp including a fixed half fabricated from a tensile material, the fixed half forming a semi-circle with a first and second end creating an opening for accepting a power cord next to a first connector. This embodiment includes the loop having two ends attached, one end each at opposing sides of a lever connected at a base end to the second end of the fixed half via a hinge.

An extension bar may be fixedly attached to the fixed half having a distal end extending past the first connector and a second connector rotatably attaching to a base securing a second power cord connected to the second connector. The loop may enabled to engage one of a plurality of anchor points fixedly attached to an outside edge of the fixed half in a linear array below the second end as in the previous embodiment described above, wherein when the loop is engaged with one of the anchors, the lever may be pushed down applying a maximum amount of pressure against the power cord immediately prior to the lever closing in a locked position thereby decreasing a dimension between the first and second ends of the fixed half. In this embodiment selection of a specific anchor to engage the loop defines a size of power cord that is secured within the fixed half.

In this embodiment, the base is comprised of two equal opposing sides with means to connect around the second power cord forming a cylinder having circular cylinder bases. In another embodiment two cylinder bases are ellipses and the means for connection enables tightening of the two sides around a variety of power cords having a smaller circumference than the cylinder having circular bases.

DETAILED DESCRIPTION OF THE DRAWINGS

In various embodiments described in enabling detail herein, the inventor provides a unique apparatus for securing an electric plug connection to prevent unintended disconnection. The present invention is described using the following examples, which may describe more than one relevant embodiment falling within the scope of the present invention.

Figure 1:
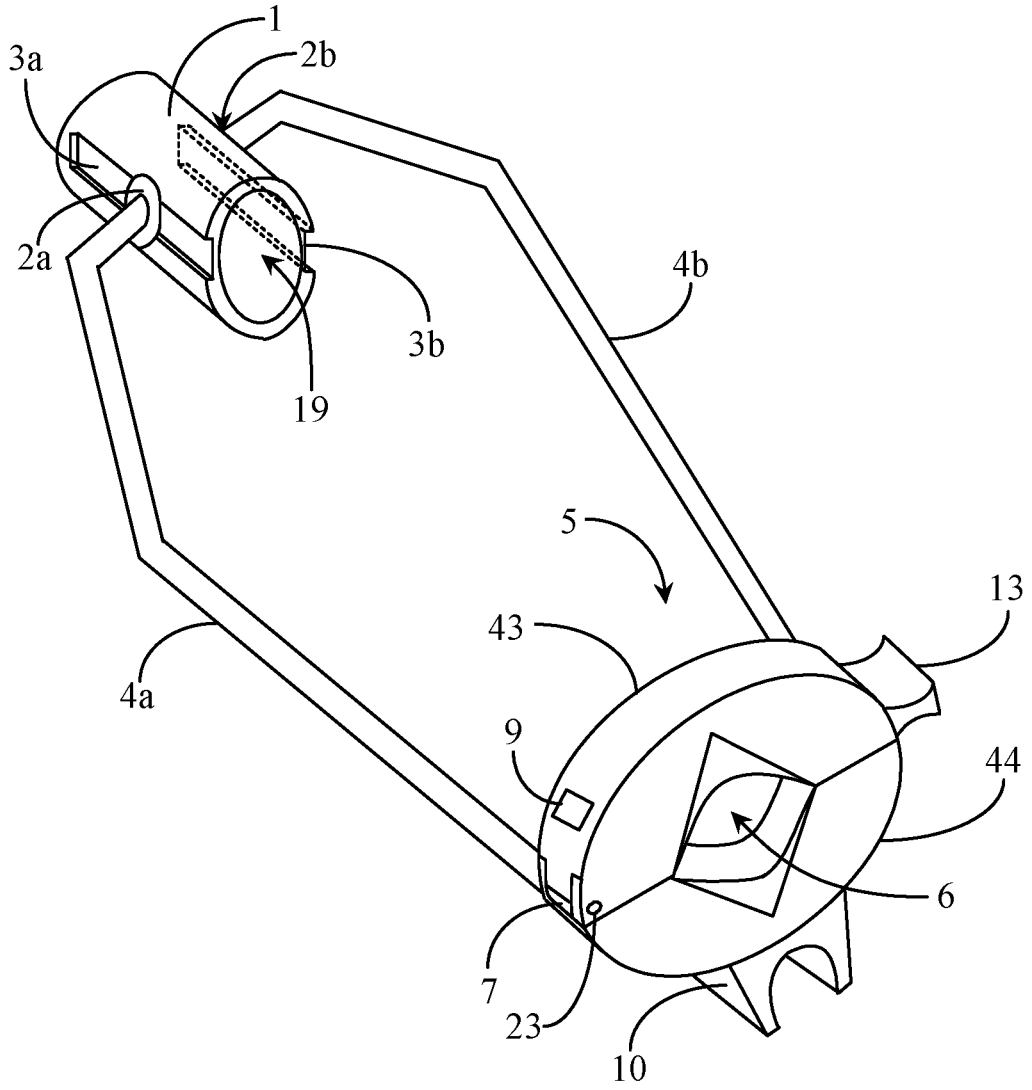
FIG. 1 is a basic version of a securement system in an unmodified form, stripped of any connectors to show components of the system.

FIG. 1 illustrates one embodiment of the securement system or device. FIG. 1 shows a first side of the device, which comprises tubular base 1. Tubular base 1 further comprises a hollow cylinder with first opening 19, hinge receptacle 2*a* and hinge receptacle 2*b* (not shown), and track 3*a* and track 3*b*. Hinge receptacles 2*a* and 2*b* (not shown) attach to tubular base 1 via tracks 3*a* and 3*b*, respectively. Hinge receptacles 2*a* and 2*b* (not shown) move slidably forward and backwards on tubular base 1 via tracks 3*a* and 3*b*, respectively. Tracks 3*a* and 3*b* can be rails attached to tubular base 1, grooves carved into base 1, recessed tracks, or any other similar means. A proximal end of bar 4*a* and a proximal end of bar 4*b* connect to tubular base 1 through hinge receptacles 2*a* and 2*b* (not shown), and a distal end of bar 4*a* and a distal end of bar 4*b* connect with clamp 5, defining the second side of the device. The second side of the device comprises clamp 5, having movable half 43 and fixed half 44. The distal end of bar 4*a* and the distal end of bar 4*b* are connected to movable half 43. Clamp 5 further comprises second opening 6, hinge 7, pin release 9, clip 10, and grip 13. Clamp 5 closes with hinge 7, which may be any type of hinge, including a ratcheting hinge or any other hinge typically used in clamps. Hinge 7 closes clamp 5 securely around different gauges of cords. Hinge 7 includes rod 23 and can be released by pin release 9. Grip 13 is permanently attached to movable half 43 and is located on the opposite side of clamp 5 as hinge 7. Grip 13 may help a user close clamp 5 with greater ease, simply grasp the device, or in any other way that is helpful to a user.

When in use, the device may connect any two conjoining connectors, and any cord attached to each connector. In one embodiment, the device may connect to a first plug, which may be a male conjoining plug or female conjoining plug, to a second plug, which may be a male or female conjoining plug. The first plug may be connected to a first power cord, and the second plug may be connected to a second power cord. The first power cord runs through first opening 19, and the second power cord runs through opening 6. Opening 6 may be comprised of any durable material, but is more preferably made of rubber or another material with grip that could adhere to the second power cord, thereby holding the second power cord in place. Clip 10 secures clamp 5 to the first power cord running through opening 19, such that the first power cord may be held in a fixed position. Clip 10 may also be used to hold either the first power cord, the second power cord, or any other cord at any time for the convenience of the user.

Hinge receptacles 2*a* and 2*b* (not shown) may optionally be able to slide forward and backwards on tubular base 1 via tracks 3*a* and 3*b*, respectively, so that clamp 5 can be adjusted to accommodate different sizes of connectors, and so that clamp 5 is directly behind a second plug. A benefit of clamp 5 landing directly behind the second plug is that it may provide an additional means to prevent accidental disconnection between a first plug and a second plug, or any two conjoining connectors.

Figure 2:
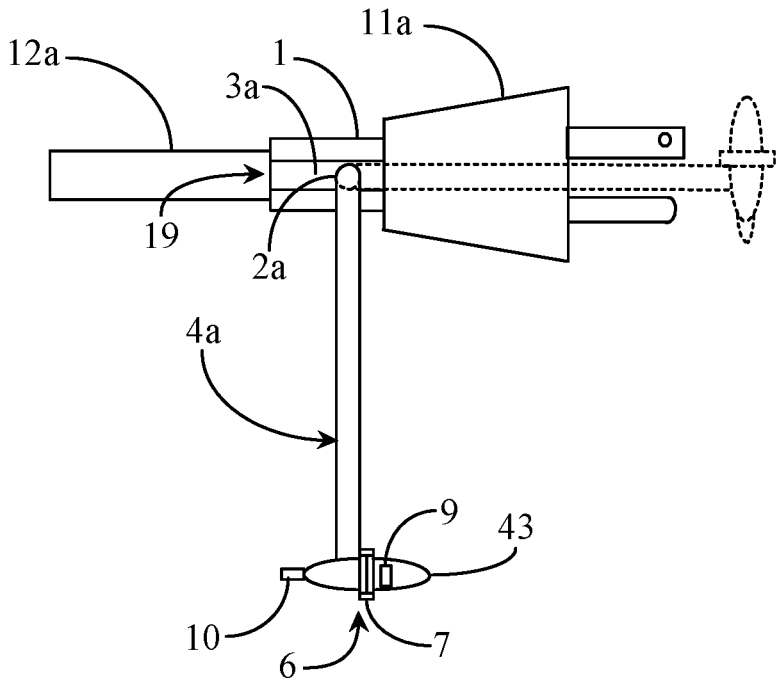
FIG. 2 shows a side view of the system with an electrical plug, illustrating how the bars move the clamp into an engaged position.

FIG. 2 illustrates a side view of an embodiment of the device in a disengaged position and an outline of bar 4*a*. Tubular base 1 is attached to first cord 12*a* running through first opening 19. First plug 11*a* may be permanently or removably affixed to power cord 12*a* and is directly adjacent to tubular base 1. In this illustration, first plug 11*a* is a male plug, and is not attached to a conjoining female plug. Hinge receptacle 2*a* and hinge receptacle 2*b* (not shown) connect with bars 4*a* and 4*b* (not shown), and enables bars 4*a* and 4*b* (not shown) to pivot clamp 5 (not shown) to an engaged or disengaged position. In this view, the device is disengaged, and bars 4*a* and 4*b* (not shown), are substantially perpendicular to tubular base 1, first plug 11*a*, and first cord 12*a*. Dotted outline of bars 4*a* and 4*b* (not shown) and the second side of the device show that bars 4*a* and 4*b* (not shown) pivot via hinge receptacles 2*a* and 2*b* (not shown), such that bars 4*a* and 4*b* (not shown) are substantially parallel to tubular base 1, first plug 11*a*, and first cord 12*a*. FIG. 2 further illustrates a dotted outline of bars 4*a* and 4*b* (not shown) and the second side of the device when in line with the first side of the device; in this position, the second side of the device and clamp are in an engaged position, such that they can stabilize the connectors and prevent disconnection. The dotted outline illustrates that devices can be moved into an engaged position.

Figure 3:
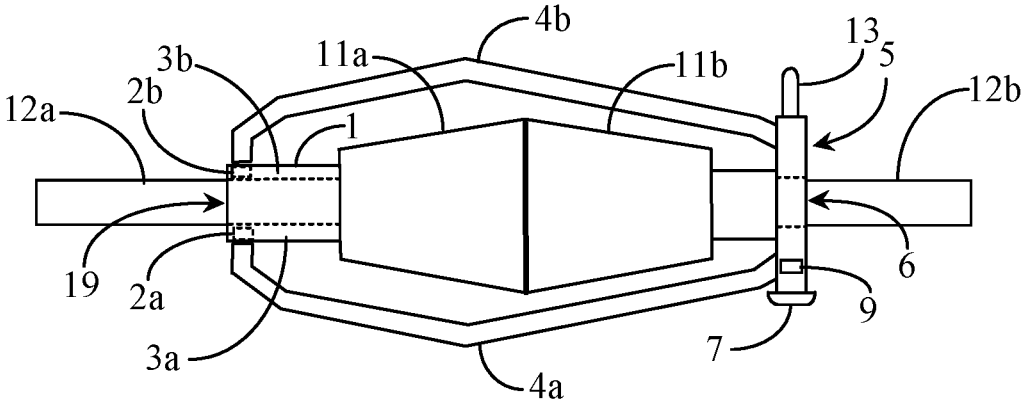
FIG. 3 shows a top view of the system securing two connectors to each other.

FIG. 3 shows a top down view of an embodiment of the device in an engaged position. Bars 4*a* and 4*b* are substantially parallel to tubular base 1, such that second opening 6 of clamp 5 is substantially aligned with first opening 19 of tubular base 1. First power cord 12*a* runs through first opening 19, and second power cord 12*b* runs through second opening 6. First plug 11*a* may be permanently, semi-permanently, or removably attached to first power cord 12*a*, and is detachably fixed to second plug 11*b*, which may be permanently, semi-permanently, or removably attached to second power cord 12*b*. First plug 11*a* may be a male plug or female plug, and second plug 11*b* is a conjoining plug that mates with either the male or female plug of 11*a*. Clamp 5 is butted up against second plug 11*b*, which provides additional stability and may further prevent accidental disconnection between 11*a* and 11*b*. Base 1 is butted up against first plug 11*a*, which also provides additional stability.

Figure 4A:
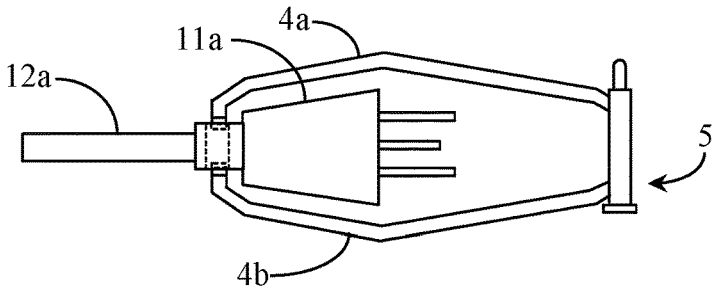
FIG. 4A shows a top view of the system with only one connector.

FIG. 4A is a top view of the device in an engaged position, with one only connector 11*a*. It shows clamp 5 when it is substantially in line with connector 11*a*.

Figure 4B:
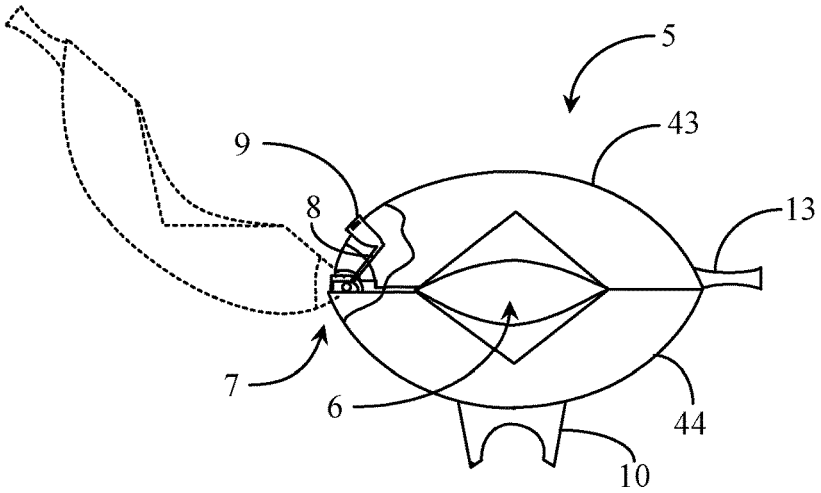
FIG. 4B shows a cross-section of the second side of the system, illustrating a clamp and parts thereof.

FIG. 4B shows a cross-section of one embodiment of clamp 5 revealing an internal mechanism for one embodiment of clamp 5. Here, clamp 5 comprises movable half 43 and fixed half 44. Grip 13 is attached to movable half 43, and serves as a grip for closing clamp 5, or otherwise adjusting the position of movable half 43. Dotted outline of movable half 43 shows clamp 5 in the open position. Clip 10 is attached to fixed half 44. Clip 10 may be used to hold the device in a disengaged position when clamp 5 is not in use, by engaging a first cord (not shown). Clip 10 may also be used to hold any cord for any reason. The portion of clamp 5 surrounding opening 6 may make contact with, and preferably grips, a second cord. Hinge 7 as illustrated here is a ratcheting hinge. Pin 8, and pin release 9 are also illustrated. When pin release 9 is depressed, hinge 7 is released, and clamp 5 may open and disengage the device, such that conjoining connectors can be disconnected and disengaged with the device. This embodiment is illustrated in more detail in FIG. 5.

Figure 5:
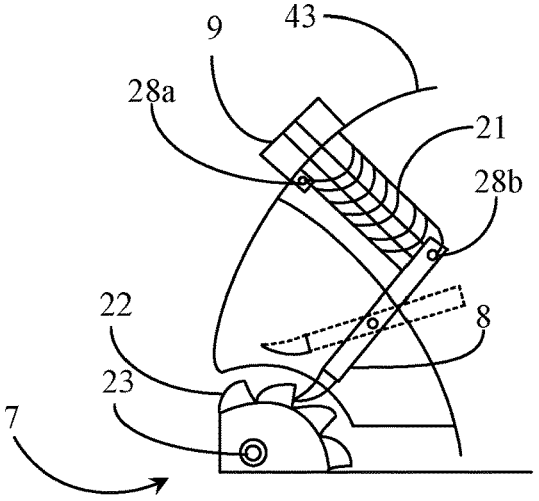
FIG. 5 is a close-up view of the clamp shown in FIG. 4B, illustrating an embodiment of a clamp's locking mechanism and a ratcheting hinge, and how the clamp and ratcheting hinge function together.

FIG. 5 is a close-up view of clamp 5 as shown in FIG. 4B, further illustrating details of this embodiment of hinge 7. The hub of hinge 7 surrounds rod 23. Movable half 43 pivots from rod 23 to open or close clamp 5. Ratcheting teeth 22 interlock with pin 8. When pin 8 engages ratcheting teeth 22, movable half 43 can only move towards fixed half 44 (not shown), closing or tightening clamp 5. This is because pin 8 can only move over ratcheting teeth 22, not against them. Spring 21 is connected to pin 8 at anchor point 28*b*, and is connected to movable half 43 at 28*a*. Spring 21 provides tension that holds pin 8 in an engaged position with ratcheting teeth 22. Pin release 9 is linked to pin 8. When pin release 9 is depressed, clamp 5 opens. When depressed, pin release 9 pushes pin 8 and pin 8 disengages from ratcheting teeth 22, as shown by dotted outline of pin 8. When pin 8 is disengaged, movable half 43 can move away from fixed half 44 (not shown) allowing clamp 5 to open.

A user may open an embodiment of clamp 5 as shown in FIG. 4A and FIG. 5 by depressing pin release 9 and grasping grip 13 or movable half 43 to pull away fixed half 44. With the clamp open, the user could remove or add a cord and connecter to the device. A user may close this embodiment of clamp 5 by simply applying pressure to movable half 43 or grip 13, such that movable half 43 moves towards fixed half 44. Pin 8 would automatically catch or engage with ratcheting teeth 22.

Figure 6:
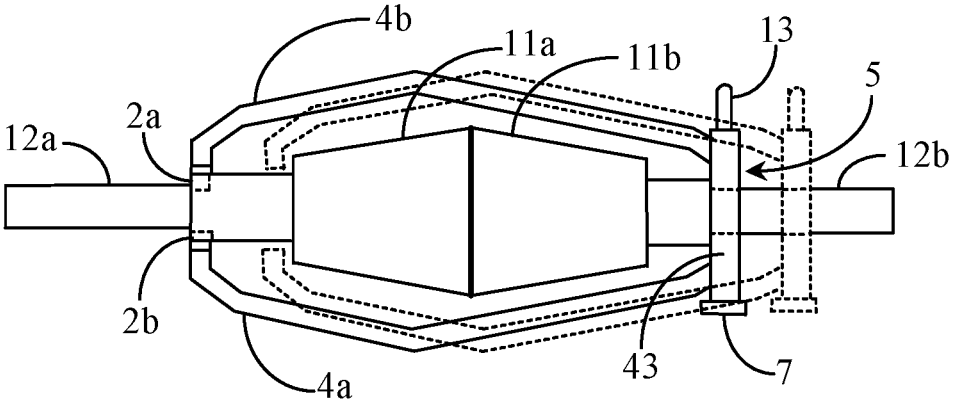
FIG. 6 shows how the bars may be adjusted to position the clamp such that it is directly adjacent to the second side of a connector, by moving the point at which bars are affixed to base of system.

FIG. 6 is a top view of the device shown in FIG. 3, with two connectors, first plug 11*a* and second plug 11*b*. Here, dotted outline of bars and second side illustrate that hinge receptacles 2*a* and 2*b* are able to slide back and forth along tubular base 1, thereby moving the second side of the device. The second side may be moved, such that clamp 5 lands directly adjacent to second plug 11*b*. The juxtaposition of clamp 5 and second plug 11*b* may ensure a more secure connection between first plug 11*a* and second plug 11*b*, thus further preventing unintentional disconnection between plugs 11*a* and 11*b*, or any two conjoining connectors. The dotted outline of bars and the second side show that clamp 5 may be pulled away from plug 11*b*.

Figure 7:
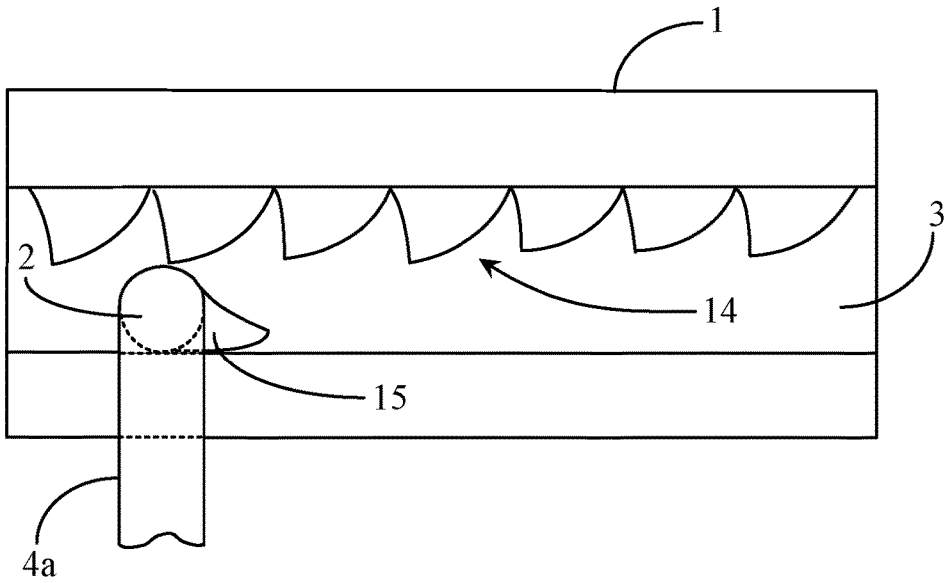
FIG. 7 shows an embodiment of a tubular base in a modified form with at least one bar in a disengaged position.

FIG. 7 shows a side view of an embodiment of tubular base 1. This embodiment shows that track 3 may be lined with grooved teeth 14. The proximal end of bar 4*a* rests in hinge receptacle 2, and rests against grooved teeth 14. Pawl 15 is fixed to the proximal end of bar 4*a*. Pawl 15 can be a pin, catch, tooth, or similar component. Bar 4*a* is perpendicular to tubular base 1. In this position, pawl 15 is disengaged from groove teeth 14, which allows bar 4*a* to slide back and forth along track 3. Bar 4*a* is not shown in its entirety because it is not necessary to show the second side of the device.

Figure 8:
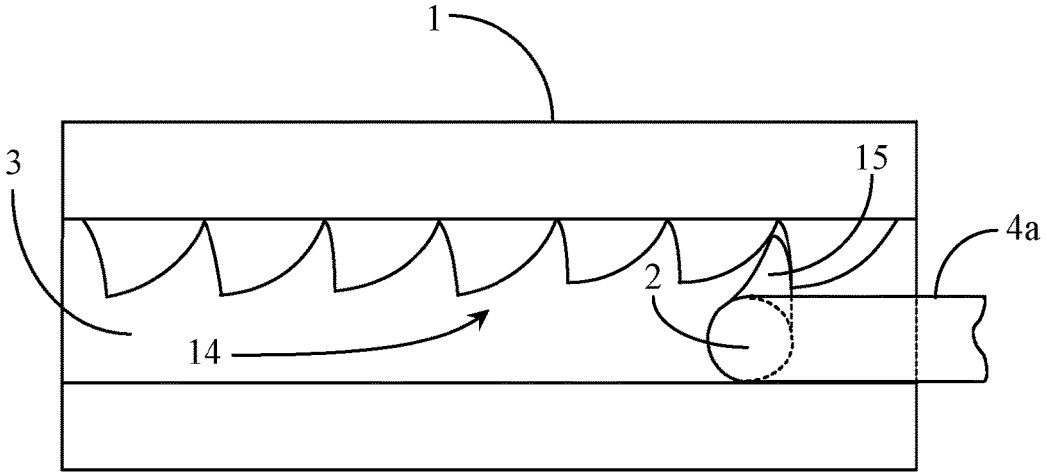
FIG. 8 shows the same version of the system illustrated in FIG. 7 with at least one bar in engaged or locked position.

FIG. 8 shows an embodiment of tubular base 1 as illustrated in FIG. 7 when bars 4*a* and 4*b* (not shown) have pivoted around hinge receptacle 2, such that bar 4*a* is in line with tubular base 1. When bar 4*a* is parallel to tubular base 1, pawl 15 pivots, such that it now engages groove teeth 14, and bar 4*a* is locked in the desired position. This locking mechanism may provide additional stability to the second side, and may further help to prevent disengagement of connectors.

Figure 9A:
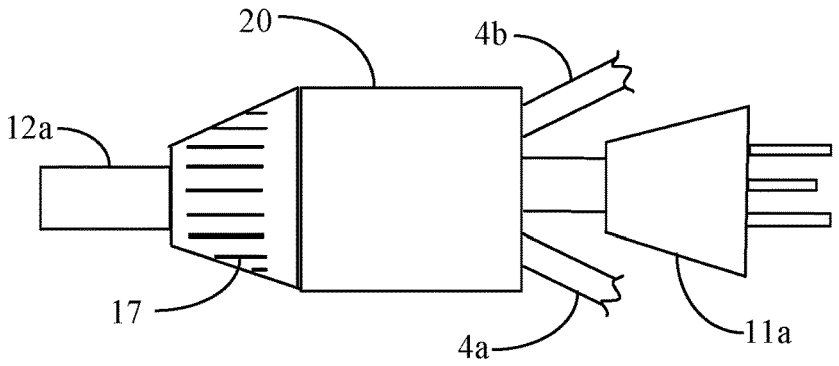
FIG. 9A shows another embodiment of the first side.

FIG. 9A is a top view of another embodiment of first side. This embodiment illustrates the first side comprising conical encasement 17 and tubular encasement 20. First power cord 12*a* runs through the center of conical encasement 17 and tubular encasement 20. Conical encasement 17 is attached to a screw top or twist top, such that when tightened a screw top or twist top may lock bars 4*a* and 4*b* into a particular position, preventing them from moving back and forth. Encasement 20 encloses moving parts of the locking mechanism as depicted in FIG. 10.

Figure 9B:
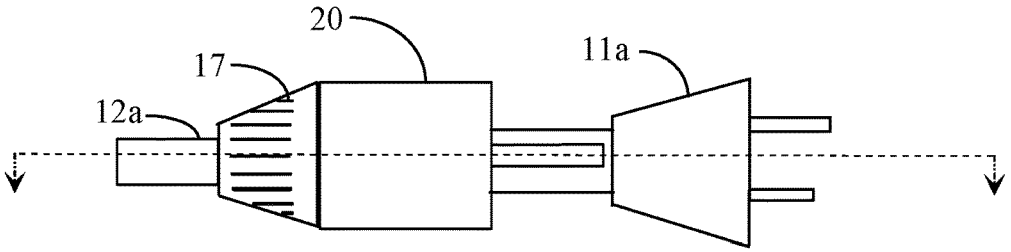
FIG. 9B identifies where the cross-section of the first side shown in FIGS. 10, 11 and 12.

FIG. 9B is a side view of the devices of FIG. 9A turned 90 degrees. The dotted line illustrates the cross-sectional view shown in FIG. 10, FIG. 11, and FIG. 12.

Figure 10:
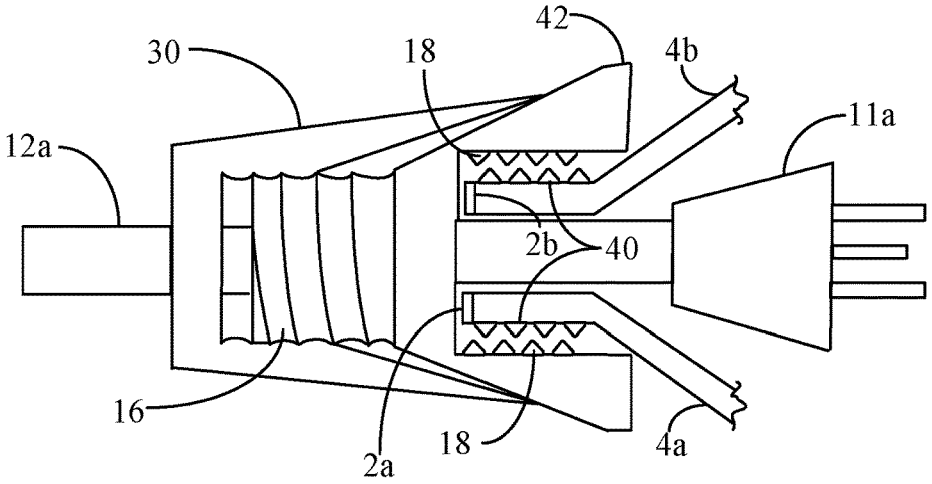
FIG. 10 shows a detailed cross-section of one embodiment of the first side illustrated in FIGS. 9A and 9B, further illustrating a screw base with multiple threads, and the bars in an unlocked position.

FIG. 10 is a cross-section showing how the depicted embodiment of the invention may function. First cord 12*a* runs through the first side, which comprises screw top 30, base screw 16, and flexible side body 42. Base screw 16 has multiple threads which engage threads at the proximal end of screw top 30. Screw top 30 engages base screw 16, such that when screw top 30 is turned, the distal end of screw top 30 applies inward pressure to flexible side body 42. Flexible side body 42 is comprised of a slightly flexible material, including but not limited to plastic, rubber, metal alloy, aluminum, tin, steel or any other suitable material. Exterior teeth 18 (not shown) are attached to flexible side body 42. Interior teeth 40 (not shown) are attached to bars 4*a* and 4*b* and are in close proximity to exterior teeth 18 (not shown). When the distal end of screw top 30 applies enough pressure to flexible side body 42, exterior teeth 18 (not shown) interlock with interior teeth 40 (not shown), such that bars 4*a* and 4*b* are fixed in position and will not slide forward or backwards.

When using an embodiment of FIGS. 9A and 9B, as further illustrated in FIG. 10, a user may slide bars 4*a* and 4*b* back and forth to adjust the location of the second side to determine a desired position. After determining a desired position, a user may lock bars 4*a* and 4*b* into position by grasping and twisting conical encasement 17, which is attached to and turns screw top 30 until screw top 30 applies enough pressure to flexible side body 42 to cause exterior teeth 18 to interlock with interior teeth 40.

Figure 11:
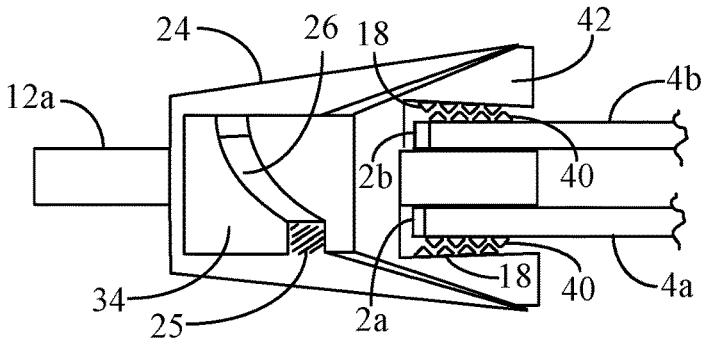
FIG. 11 is another embodiment of the screw base illustrated in FIGS. 9A and 9B, illustrating a screw base with a single groove and the bars in a locked position.

FIG. 11 is another embodiment of the first side in a locked position. Here, base screw 16 and screw top 30 of FIG. 10 are replaced with twisting base 34 having single groove 26, twisting top 24, and notch 25. Twisting top 24 moves notch 25 along groove 26. As notch 25 travels down groove 26, twisting top 24 moves downward, which causes the distal end of 24 to apply increasing pressure to flexible side body 42. Here, notch 25 is in a locked position, and the distal end of twisting top 24 applies enough pressure to flexible side body 42 to cause exterior teeth 18 to interlock with interior teeth 40. Thus, bars 4*a* and 4*b* are fixed in position and will not slide forward or backwards. This embodiment may allow bars 4*a* and 4*b* to become engaged and disengaged more efficiently than the embodiment shown in FIG. 10B, because doing so requires less motion to lock exterior teeth 18 with interior teeth 40.

Figure 12:
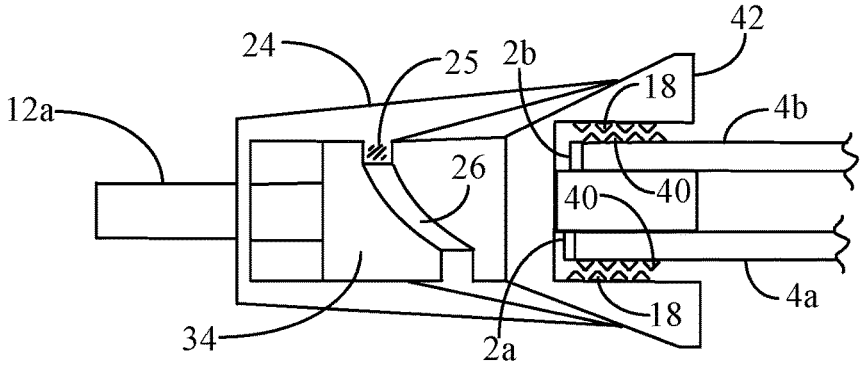
FIG. 12 illustrates the screw base of FIG. 11 with bars in an unlocked position.

FIG. 12 shows the device of FIG. 11 in an unlocked position. Notch 25 is at the top endpoint of groove 26. This position releases pressure on flexible side body 42 such that exterior teeth 18 are disengaged from interior teeth 40.

Figure 13:
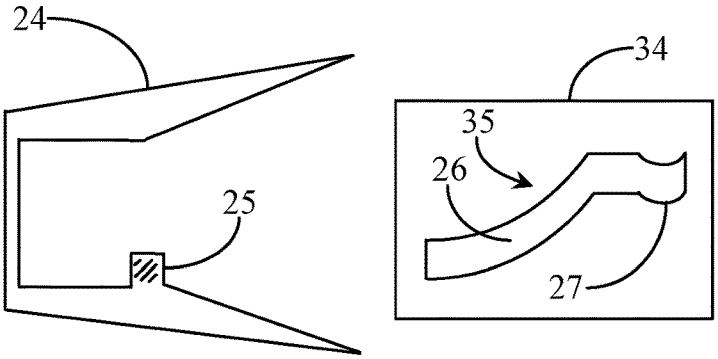
FIG. 13 shows male and female parts of the screw base illustrated in FIG. 11 disassembled. The cylindrical male aspect is flattened to show full pattern of groove.

FIG. 13 shows a view of the twisting base 34 unrolled as groove pattern 35. Notch 25 of twisting top 24 is depicted, and interlocks with groove 26. Groove pattern 35 is an unrolled view of the full circumference of groove 26 illustrating an incline and divot 27. Notch 25 slides along groove 26, and in relation, moves twisting top 24 into, or out of, an engaged position. Divot 27 at the top of groove 26 holds notch 25 in an engaged position.

When using an embodiment of FIGS. 9A and 9B, as further illustrated in FIGS. 11, 12 and 13, a user may slide bars 4*a* and 4*b* back and forth to adjust the location of the second side to determine a desired position. After determining a desired position, a user may lock bars 4*a* and 4*b* into position by grasping and twisting conical encasement 17, which is attached to and turns twisting top 24 until twisting top 24 applies enough pressure to flexible side body 42 to cause exterior teeth 18 to interlock with interior teeth 40. This typically occurs when notch 25 is in a locked position. In some embodiments, a user may engage or disengage with as little as an approximately 90 degree turn of conical encasement 17, as much as a 360 degree turn of conical encasement 17, and preferably a 180 turn of conical encasement 17.

Figure 14:
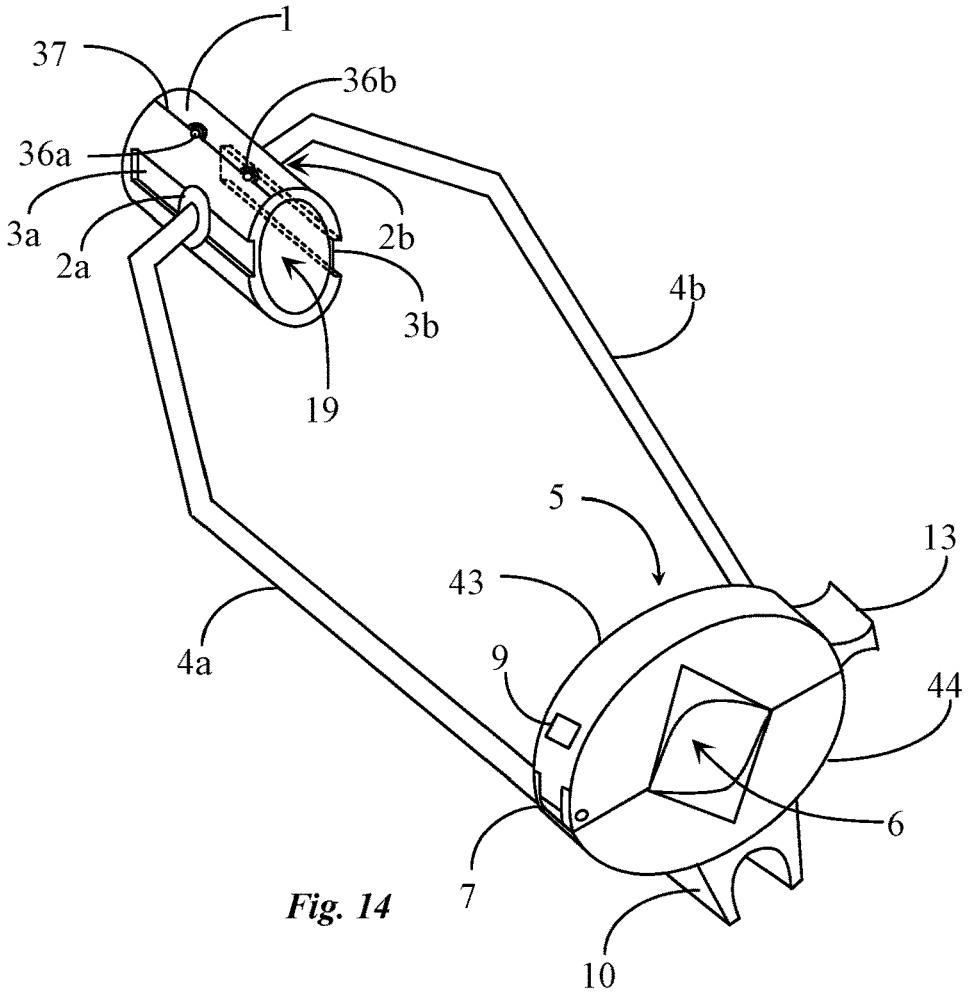
FIG. 14 is a modified embodiment of the system of FIG. 1 of invention, which may be used for aftermarket applications.

FIG. 14 shows another embodiment similar to the device shown in FIG. 1. In this embodiment, tubular base 1 further comprises split 37 and screws 36*a* and 36*b* that hold tubular base 1 together. Split 37 and screws 36*a* and 36*b* may also allow the device to be applied as an aftermarket application. While this embodiment shows two screws, other embodiments could have as few as one screw and as many as five screws to enable aftermarket application to a cord. Additionally, split 37 could also be secured in a closed position by one or more magnets, one or more loops, one or more clasps, one or more fasteners, or any other means known in the art.

Figure 15:
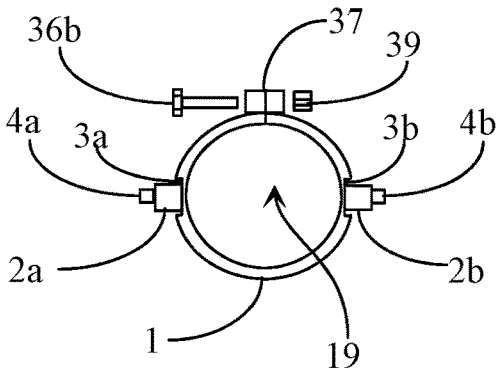
FIG. 15 shows a horizontal view of base in FIG. 14.

FIG. 15 is a front view of tubular base 1 similar to the one depicted in FIG. 14. In this case, only one screw holds split 37. Here, split 37 is on one side of tubular base 1, which further comprises a loop or other means to attach screw 36*b*. Screw 36*b* is held in place with nut 39, and holds split 37 together.

Figure 16:
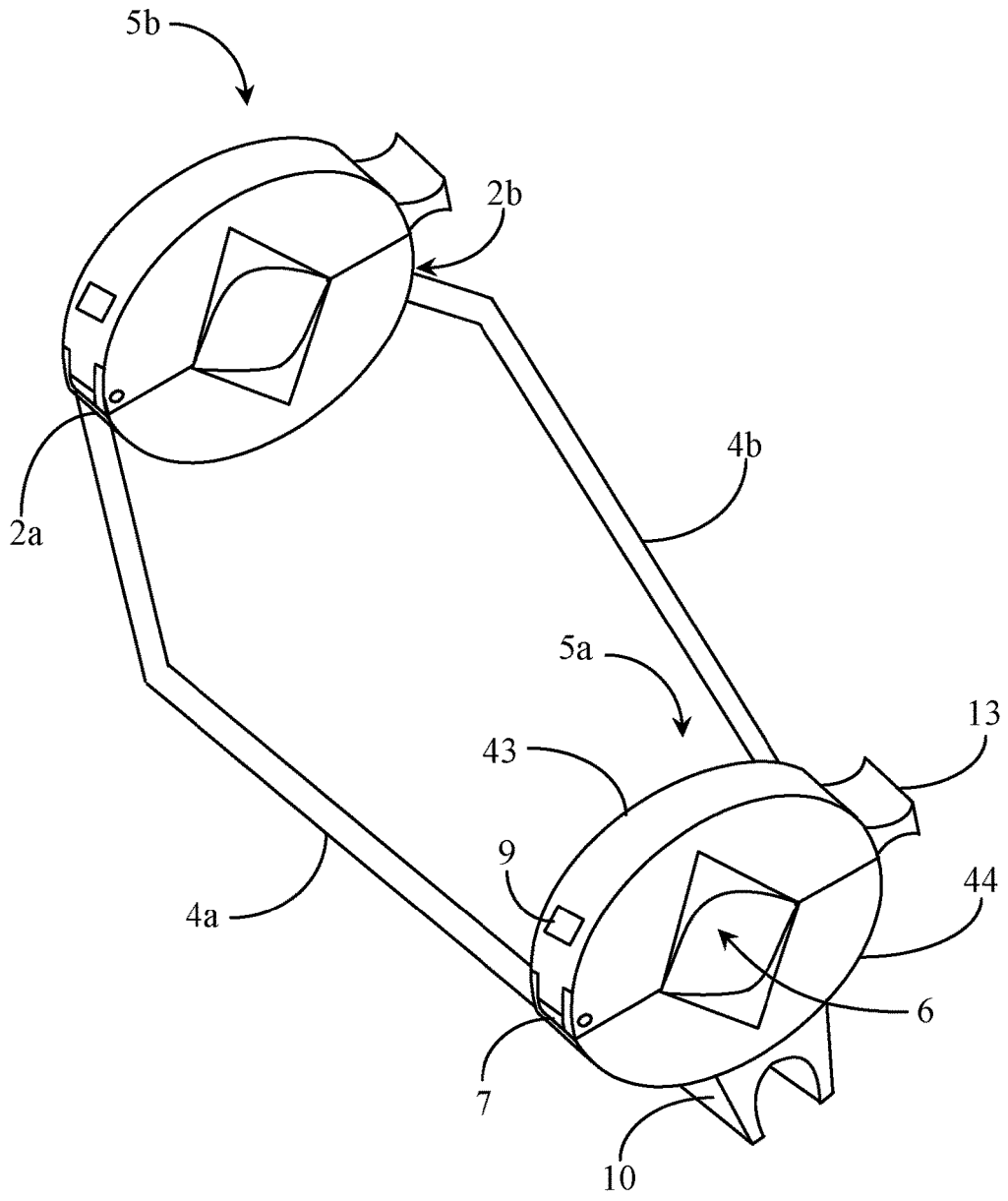
FIG. 16 is another embodiment of the system where the first end and the second end are both comprised of clamps, which may be for semi-permanent use.

FIG. 16 illustrates a semi-permanently applicable embodiment where the first side comprises clamp 5*a*, which further comprises second opening 6, hinge 7, pin release 9, clip 10, and grip 13. Clamp 5*a* also illustrates movable half 43 and fixed half 44. Clamp 5*b* may comprise the same components of clamp 5*a*, and further comprises hinge receptacles 2*a* and 2*b*. Clamp 5*b* is optionally a means to enable bars 4*a* and 4*b* to move in relation to clamp 5*a*, such that clamp 5*a* can be adjusted forwards and backwards, as to accommodate connectors of varying sizes. Any means of enabling bars 4*a* and 4*b* to move back and forth in relation to the second side as described herein are also applicable to this embodiment.

Figure 17:
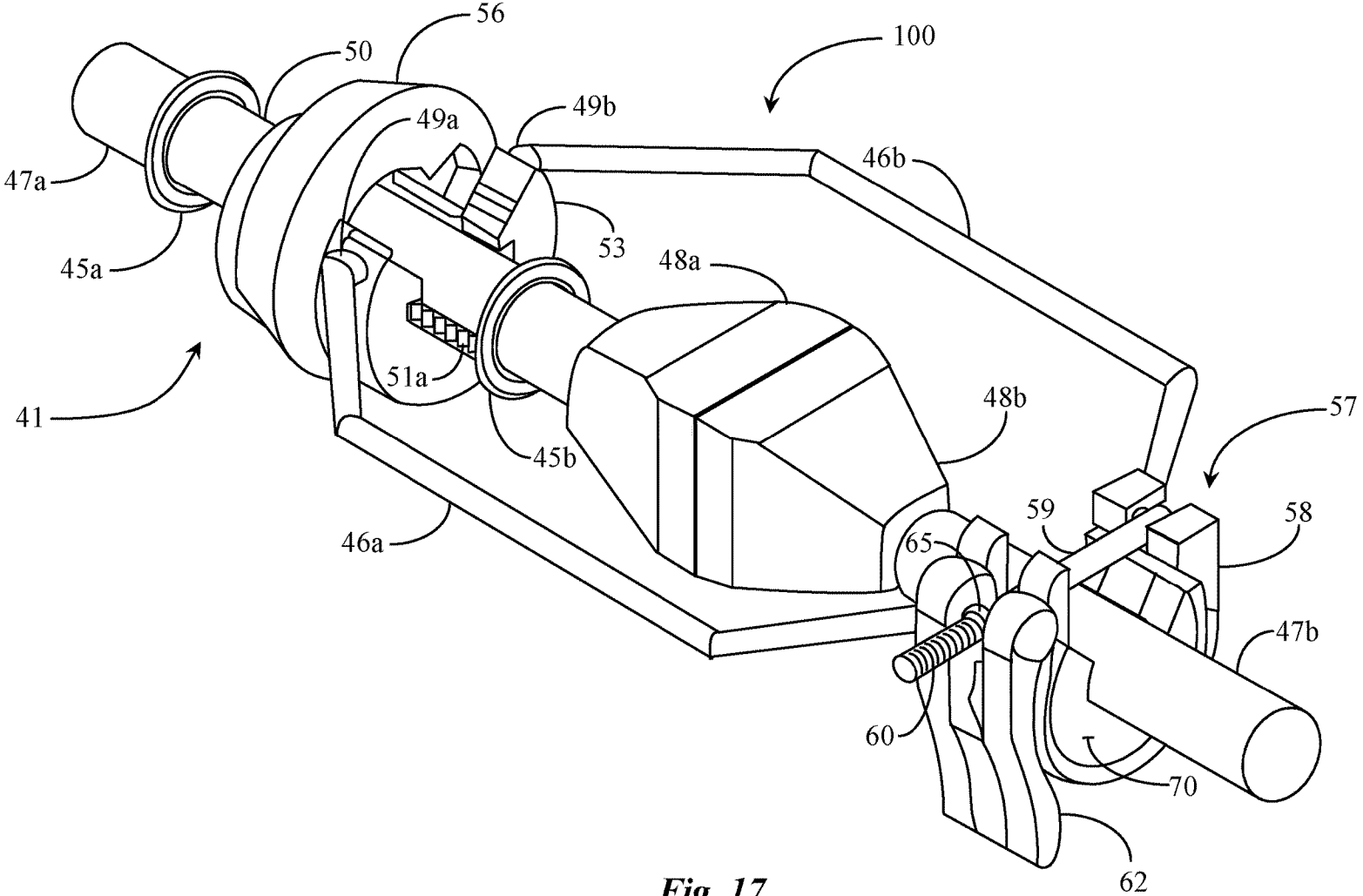
FIG. 17 is a perspective view of a plug clamp system according to an embodiment of the present invention.

FIG. 17 is a perspective view of a plug connection securing clamp system 100 according to an embodiment of the present invention. Plug securing clamp system 100 is provided to secure the connection of a male and female plug, depicted herein as a first male plug 48*a* and a second female plug 48*b*. Plug securing clamp system 100 may be referred to hereinafter in this specification as clamp system 100 or simply as clamp system 100.

Clamp system 100 includes a base point locking assembly 41 on one side (powered appliance) and a cam clamp assembly on the opposite side (power cord to outlet). An appliance or device may include power tools (drills, saws, blowers), service nodes (candy machines, slot machines, information kiosks), utilities (washer, Dryer, heater, refrigerator). Base point locking assembly 41 and cam clamp 57 are connected by a first extension bar 46*a* and a second extension bar 46*b*. Extension bars 46*a* and 46*b* may be fabricated from aluminum, or another metal bar or may be a resilient molded product made of a durable polymer without departing from the spirit and scope of the present invention. In one embodiment extension bars 46*a* and 46*b* are metal rods formed or bent (segmental) to clear the plug connection comprising plug 48*a* and plug 48*b*. In another embodiment extension bars 46*a* and 46*b* may be accurate or parabolic in form without departing from the spirit and scope of the invention.

Base locking assembly 41 includes a base cylinder 50 having an inner diameter that is just larger than the outer diameter of the first power cord 47*a* (device side) such that it may be installed over the power cord at the time of production or as an aftermarket application with some modification that will be detailed later in this specification. Base cylinder 50 includes a first stop flange 45*a* and a second stop flange 45*b* formed or otherwise fabricated at each end of the cylinder body. Stop flanges 45*a* and 45*b* function to prevent a tapered cylinder jacket 53 from sliding off the base cylinder after installation of the jacket over the cylinder.

Tapered cylinder jacket 53 may be installed over base cylinder 50 such that it may freely slide over the cylinder but be stopped from sliding off the cylinder by the stop flanges as described immediately above. Cylinder jacket 53 may be somewhat conical in form being of a larger outer diameter at the forward side (facing plug) and smaller in diameter at the rearward side. In a preferred embodiment, the outer periphery of cylinder jacket 53 may be threaded to accept a turn nut 56. Cylinder jacket 53 and has a longitudinal cutout sufficiently large enough to enable installation of the jacket over and onto the base cylinder by expanding the jacket and snapping in onto the cylinder between the stop flanges at either end of the base cylinder. Once installed it may freely slide back and forth over the cylinder between the flange stops.

In this implementation base cylinder jacket has extension bar receptacles 49*a* and 49*b* located in a fixed position, one each on opposite sides of the base cylinder jacket 53. Receptacles 49*a* and 49*b* function to accept ends of extension bars 46*a* and 46*b* so they may pivot freely.

Base cylinder 50 includes a first linear tooth array 51*a* strategically aligned with longitudinal center of the cylinder. Base cylinder 50 has a second linear tooth array 51*b* strategically located opposite of tooth array 51*a* and in alignment with longitudinal center of the cylinder. Cylinder jacket 53 includes a pair opposing longitudinal grooves (not depicted here)

formed on the inside wall of the jacket. The grooves may be aligned over the tooth arrays when installing cylinder jacket 53 over base cylinder 50. The grooves may include one or more teeth symmetrically aligned relative to both grooves that may be urged inward relative to the inner diameter of the jacket to catch onto tooth arrays 51*a* (visible) and 51*b* (not visible). Turn nut 56 has threading about its inner wall that matches the outer threading on jacket 53. The inner diameter of turn nut 56 at the small end is sufficiently large enough to clear the first stop flange 45*a* so that the turn nut 56 may be installed over and engaged to jacket 53.

In this implementation, jacket 53 may be urged inward by advancing turn nut 56 such that the grooves and tooth pattern on the inside wall of jacket 53 closes over tooth arrays 51*a* and 51*b* to cause opposing tooth engagement and lock of jacket 53 in a desired position on base cylinder 50. Extension bars 46*a* and 46*b* are pivotally attached to jacket 53 and therefore adjustment of the jacket over the base cylinder determines the distance of cam clamp 57 relative to second plug 48*b*. This feature accommodates plugs of differing lengths a provides an incremental method of setting a proper distance for cam clamp 57 on the distal end of the apparatus. Extension bars 46*a* and 46*b* may or may not pivotally attach to cam clamp main clamp ring 58. In one implementation, extension bars 46*a* and 46*b* may be bridged together by one or more cross members such that they both may swing or pivot down in tandem and back up relative to base mechanism 41.

Cam clamp 57 includes a main clamp ring 58. Clamp ring 58 is open at the top and at both ends. Clamp ring 58 may be fabricated of a resilient but flexible metal or other material having the ability to flex inward somewhat and then spring back out to an original state. Clamp ring 58 may have an inner component or cord grip material 70. Material 70 may be a rubber material, a cork material or a similar material that may expand and contract under clamp operation. Cord material 70 may be in the form of an insert that is annular and has an inner diameter that is large enough to accept power cord 47*b*. In one implementation, material 70 may be a thick coating of material adhered to the inside wall of clamp ring 58 whereby a passage through which power cord 47*b* may pass through may be formed. In this implementation, there is a cutout portion that provides enough relief area to accept the diameter of cord 47*b* into its center.

Cam clamp 57 includes a clamp bar 59. Clamp bar 59 may be provided of a steel material, an aluminum material or another durable material that may hold a thread. In this implementation, clamp bar 59 has a length that exceeds the overall width of cam clamp 57 and has external threads 60 proximal to one end. Clamp bar 59 may be attached to main clamp ring 58 via a hinge pin (not visible). Clamp 57 includes a cam lever 62. Cam lever 62 is strategically shaped to interface with a pair of divots provided at the lever interfacing side of main clamp ring 58. Clamp lever 62 may be installed onto clamp bar 59 via a threaded lever nut 65 having external mounted pins (not visible) for insertion into openings provided on the inside surface of the lever. Lever 62 includes a cut out relief portion to enable the lever to clear the clamp bar in operation.

Figure 18:
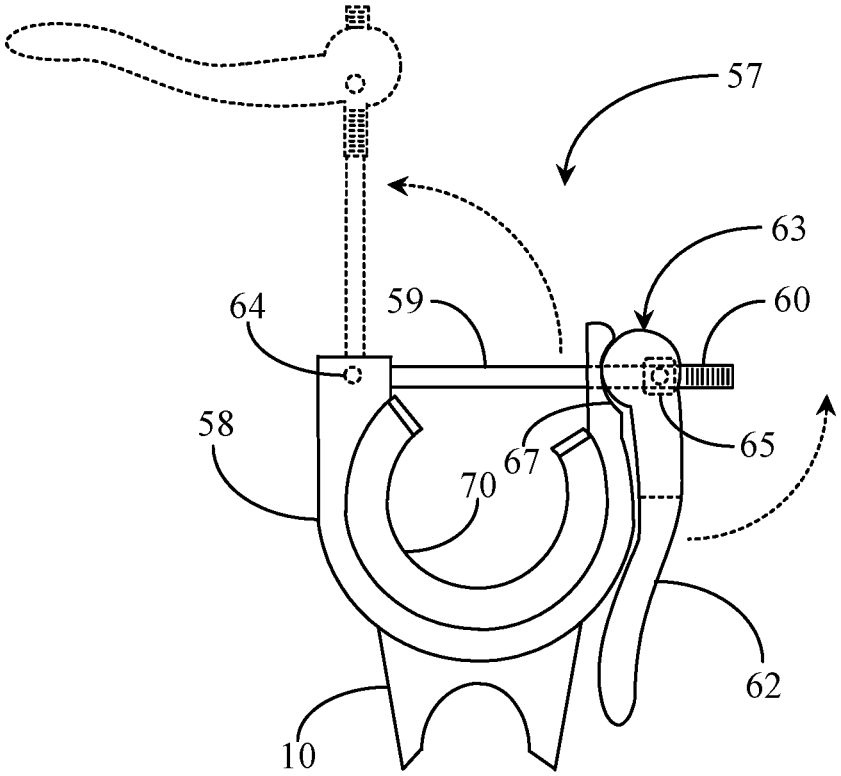
FIG. 18 is an end view of a lever controlled cord clamp of FIG. 1 depicting a closed and an open position.

Cam clamp lever 62 may be threaded onto threading 60 at the free end of clamp bar 59 via lever nut 65 and may be advanced or retracted along the threading 60 in order to adjust the resistance of the lever against main clamp ring 58 to affect a tighter or looser clamping of power cord 47*b* in operation. Lever 62 has rounded base parts that fit radially into divots provided in main clamp ring 58 through forming or machining. In this embodiment FIG. 18 is an end view of lever-controlled cam clamp 57 of FIG. 1 depicting a closed and an open position. Cam clamp 57 is viewed from one end in this example and includes a power cord grip that has been discussed in one or more parent specifications to this specification. Referring now to FIG. 1 included herein at least by reference cord clip 10 is depicted and described and therefore shall retain the same element number and serves the same function previously described. Cam lever 62 includes a rounded top surface or interfacing bulb 63 that fits radially into a divot 67 on the interface portion of main clamp ring 58. Interfacing bulb 63 is circular and may or may not be symmetrical. Additionally, Cord grip material 70 may be of a larger or smaller inner diameter without departing from the spirit and scope of the present invention.

In a preferred embodiment, a power cord such as cord 47*b* will have an outer diameter just small enough to enable the cord to pass through the inner diameter of cord grip material 70 when cam clamp 57 is in the open position. Threaded lever nut 65 (broken Boundary) enables a user to adjust the clamping force of clamp 57 via threading 60 on clamp bar 59. Clamp bar 59 is attached via hinge pin 64 (broken boundary).

A user may lift up on cam lever 62 in the direction of the adjacent directional arrow (broken line) to loosen clamp 57. Clamp bar 59 and lever 62 may be lifted up and off of main clamp ring 58 to the elevated position as denoted herein by a second directional arrow and broken boundary lines representing lever 62 disengaged with the clamp and the second directional arrow indicating pivot about hinge pin 64. Cord grip material 70 may be a permanent of semi-permanent material adhered to the inside of main clamp ring 58 via a glue. In one implementation, cord grip material 70 may be an insert that may be one of one or more available inserts of differing inside diameters for accepting and gripping power cords of different diameters.

Figure 19:
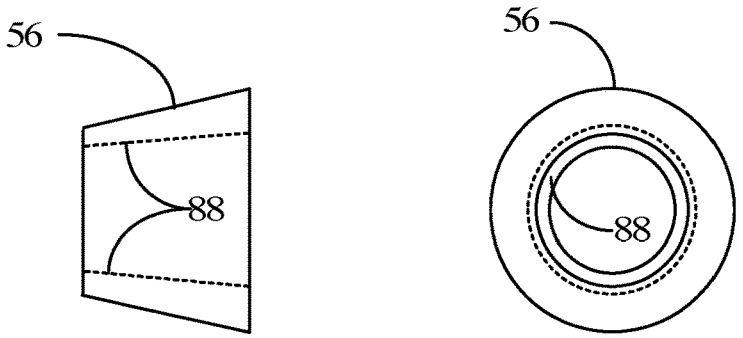
FIG. 19 depicts a left side view and a right end view of the base clamp turn nut of FIG. 17.

FIG. 19 depicts a left side view and a right end view of base clamp turn nut 56 of FIG. 17. Turn nut 56 may be manufactured of a durable polymer or a metal that accepts threading. Turn nut 56 is somewhat conical or having taper from a larger diameter to a smaller diameter. Turn nut 56 has internal threading 88 about the inside wall. Internal threading 88 matches external threading 66 depicted in FIG. 21 for cylinder jacket 53. In the end view, surface of internal threading 88 is visible. Threading may be tapered and course for the purpose of advancing the turn nut onto the threaded exteriors of the cylinder jacket whereby the cylinder jacket may be urged inward to lock the jacket in a linear position over the base cylinder depicted in FIG. 20 and to clamp the assembly over a power cord on the appliance side of the lager apparatus.

In one embodiment turn nut 56 may be installed over a power cord before a power plug is installed on the cord. In another embodiment turn nut 56 may include a cutout along its length of sufficient width to enable installment of the nut onto a power cord that already has a plug connected. In another embodiment, turn nut 56 may comprise two pieces that are connected by a hinge whereby the nut may be opened and then closed over the power cord snapping shut to provide the annular nut for threading one the jacket 53.

Figure 20:
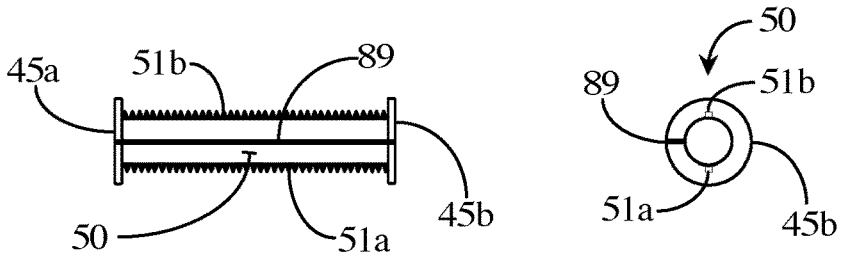
FIG. 20 depicts a left side view and a right end view of the base clamp cylinder of FIG. 17.

FIG. 20 depicts a left side view and a right end view of base cylinder 50 of FIG. 17. Base cylinder 50 includes opposing linear tooth arrays 51*a* and 51*b* and stop flanges 45*a* and 45*b*. In one implementation for aftermarket appliances and devices, cylinder 50 includes a slit or linear cut 89 through one cylinder wall to enable cylinder 50 to be expanded for aftermarket installation over a power cord having a plug on the end. Through slit or linear cut 89 may be relatively wide such that the cylinder may be expanded to cause the cut to attain a width just larger than a power cord over which the cylinder may be installed. In this case, the cylinder may be manufactured of a spring steel so that it may be expanded and may retract of its own accord once over the power cord. In one embodiment, cylinder 50 may be a two-piece cylinder that is hinged and that includes a snap lock hardware so that it may be unlocked, opened via hinge and then closed over a power cord and locked such that it remains firmly on the cord.

Cylinder 50 may be manufactured with an inside diameter that is just smaller than the outside diameter of the power cord so that it has sufficient frictional contact with the power cord so as not to slide without force applied. In one implementation, the inside diameter of cylinder 50 may be coated with rubber or another material to make gripping the power cord easier. Other architectures for cylinder 50 may be considered without departing from the spirit and scope of the present invention such as two-piece assembly that may be bolted or snapped together over the power cord.

Figure 21:
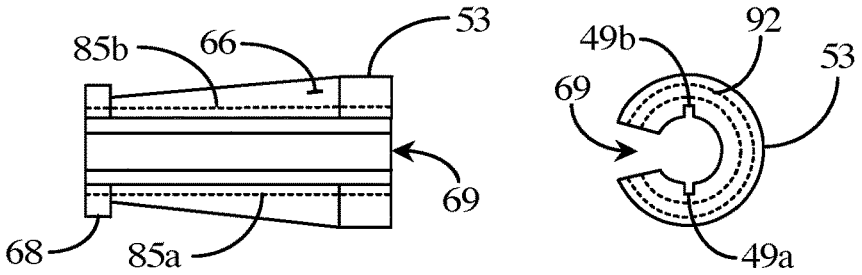
FIG. 21 depicts a left side view and a right end view of the base clamp cylinder housing of FIG. 17.

FIG. 21 depicts a left side view and a right end view of base clamp cylinder jacket 53 of FIG. 17. Jacket 53 may be tapered or somewhat conical with reference to the outer wall profile. The tapered external wall may be threaded with threads 66 that match the internal threads 88 on the inner wall of turn nut 56. Therefore, advancing the turn nut causes the jacket to contract over the base cylinder is its aligned position. One end of jacket 53 is fitted with stopper 68 to prevent the turn nut from coming off the jacket. If Jacket 53 is tapered stopper 68 is situated at the tapered end of jacket 53.

Jacket 53 may be manufactured of a resilient material that may be expanded physically to install it over the base cylinder wherein the jacket resumes its original dimensions after release over the cylinder. Jacket 53 includes a cutout 69 through the outer wall breaking out into the center of the piece enabling the expansion. Cutout 69 enables jacket 53 to be expanded over the base cylinder.

Jacket 53 includes opposing grooves 85*a* (first groove) and 85*b* (second groove) that may be aligned over first tooth array 51*a* and second tooth array 51*b* of cylinder 50 of FIG. 20. In one implementation, grooves 85*a* and 85*b* align with tooth arrays of the base cylinder and the grooves are slightly larger in width than the width of the tooth arrays enabling such alignment when the jacket is installed over the base cylinder.

In the same implementation, grooves 85*a* and 85*b* may contain one or more teeth or apertures that may make contact with the tooth arrays when the turn nut is advanced a certain distance over the jacket causing the jacket to lock in its linear position over the base cylinder. In one embodiment, the bottoms of groves 85*a* and 85*b* contain a ridge pattern so that when the jacket is urged inward via advancing the turn nut there over, the ridges make contact with the tooth arrays to lock the jacket into its linear position on the base cylinder.

It will be apparent to one with shill in the art that tapers and angles may vary relative to threaded surfaces of the jacket and turn nut without departing from the spirit and scope of the present invention. It will also be apparent to one with skill in the art hat cutout 69 may extend only partially along the jacket and does not have to extend the total length of the jacket. Moreover, in such an implementation there may be more than one cut out in jacket 53 to ease closing of the jacket over the tooth arrays on the base cylinder wherein those cutouts do not extend the entire length of the jacket so as not to split the piece into two or more pieces. For example, one or more cutouts 69 may extend only to the flange portion of the jacket so that the jacket is held together.

Figure 22:
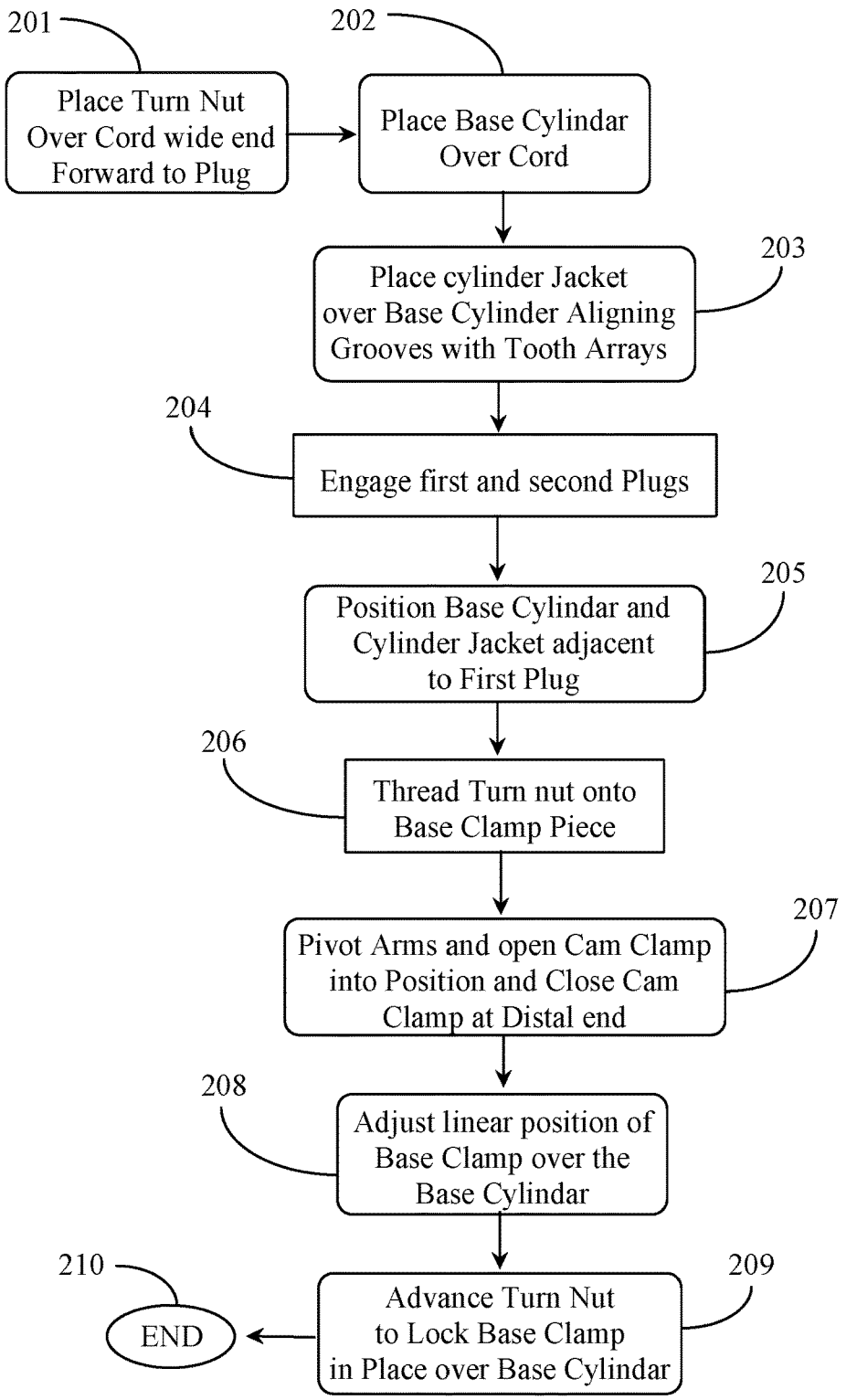
FIG. 22 is a process flow chart depicting steps for installing the plug and socket securing system of FIG. 17 onto conjoined male and female plugs according to an embodiment of the present invention.

FIG. 22 is a process flow chart depicting steps for installing the plug and socket securing system of FIG. 17 onto conjoined male and female plugs according to an embodiment of the present invention. At step 201 a user may install threaded turn nut over a power cord connected to a powered appliance with the wide end facing the plug. In one embodiment, the user may install the nut before installing a plug to the power cord. In another embodiment, the architecture of the nut allows for opening the nut and then closing it over a power cord via hinge and snap lock or via a longitudinal cutout provided in the nut in order to clear the diameter of the cord that already has a plug installed in an aftermarket application.

At step 202 the use may install or place a base cylinder over the power cord of the powered appliance or device such as base cylinder 50 of FIG. 20. The base cylinder may be designed with a through slot running its length to enable expansion out of the cylinder to overcome the diameter of the power cord. A solid cylinder with no through slot or cutout may be installed before a plug is installed in an OEM embodiment. In one embodiment, a user may install the based cylinder and turn nut over the power cord before adding a plug at the end.

At step 203 the user may place the cylinder jacket over the base cylinder. The cylinder jacket may include a cutout that allows it to be physically expanded to accept a standard power cord by way of a longitudinal cutout for example physically pressing the cord through the gap left by the through slot. There may be more than one longitudinal cutout along the length of the cut out as long as the rest of the jacket is connected at one end. At step 204, the user may connect the male and female plugs together before making adjustments to form the base lock assembly. A this point the first and second plugs may be engaged at step 204.

At step 205, the user may position the base cylinder with the cylinder jacket installed there over proximal to or adjacent to the first plug. At this juncture, the jacket is freely slidable over the base cylinder so the user may gauge distance relative to the cam clamp at the distal end of the apparatus to determine where the jacket should be on the base cylinder before proceeding. The extension bars 46*a* and 46*b* connected to the cam clamp will freely pivot at the connections to the cylinder jacket.

At step 206, the user may start the threaded turn nut onto the cylinder jacket and advance the nut some distance onto the assembly but shy of locking the parts together relative to linear relationship.

At step 207, the user may pivot the rest of the apparatus namely the extension bars and open cam clamp into position over the power cord leading to outlet and then may close the cam clamp over the other power cord locking the connected plugs together preventing them from being unintentionally disconnected. Here the cylinder jacket is still slidable over the base cylinder so that fine tune adjustment may be made.

At step 208, the user may visually select a linear position of the cylinder jacket over the base cylinder and may advance the turn nut at step 209 until the cylinder jacket is locked onto the teeth of the base cylinder. At this point the user may gauge distance relative to where the cam clamp is connected on the other side of the plug connection and make subsequent adjustments if necessary by backing the turn nut off and repositioning the cylinder jacket relative to the base cylinder and re-advancing the turn nut to lock the components together. The user may at any time readjust the linear position of the cylinder jacket over the base cylinder by loosening the turn nut and re-positioning the cylinder jacket and then re-advancing the turn nut to lock it down over the base cylinder. The process ends at step 210. Reverse procedure may be unlocking the cam clamp by lifting up the cam lever to disconnect the female plug (second plug).

The user may leave the apparatus connected to the power cord of the appliance until next use. In one embodiment where the components are designed for aftermarket application, the user may remove them and store or use for another appliance.

Figure 23:
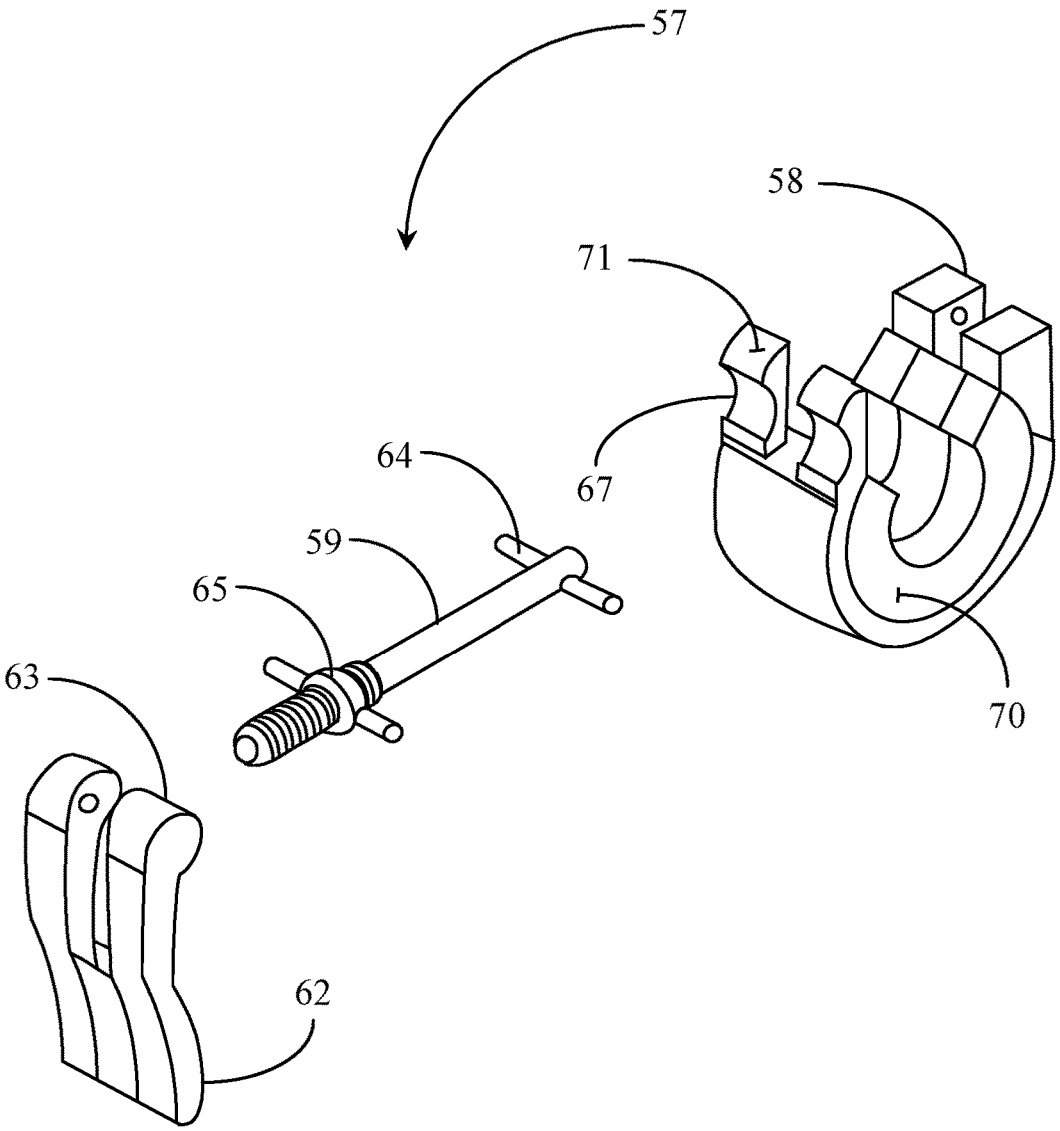
FIG. 23 is a perspective view of components of the cord clamp of FIG. 17.

FIG. 23 is a perspective view of components of cam clamp 57 of FIG. 17. Cam clamp 57 includes a clamp ring 58 with cord grip material 70 positioned to accept a power cord. Clamp ring 58 includes a mounting post for mounting clamp bar 59 to the clamp ring via hinge pin 64. Openings provided at least on the inside walls of the mounting post may be through holes or blind holes without departing from the spirit and scope of the present invention. The openings are sufficiently large in diameter to enable free rotation of the clamp bar at the pivot point or hinge pin 64.

Cam lever 62 mounts to threaded lever nut 65. Lever nut 65 may be threaded back and forth along threading at the end of the bar clamp. Adjusting the lever nut may be performed with lever 62 mounted or not. Lever 62 includes round or radial interfacing spherical bulbs 63 that fit into divots 67 on the interfacing side of the posts on main clamp ring 58. The divots are positioned to accept the spherical ends of the lever in a closed position and the pin receptacles are offset from a center of the two spherical ends away from a surface of the two spherical ends that engage the divots, wherein as the lever is pulled down in a closed position against the fixed half, an amount of pressure against the divots increases reaching a maximum amount of pressure immediately before the clamp is fully closed decreasing the distance between the first end and the second end of the fixed half thereby securely locking the clamp bar in place over the second power cord.

In one embodiment hinge pin 64 and lever nut 65 may be spring loaded assemblies whereby an internal spring mechanism enables the pins to be collapsed for installation of clamp bar 59 onto main clamp ring 58 and lever 62. Lever 62 has a relief area of material removed for the purpose of clearance of the threaded end of bar 59 when opening and closing the clamp. The interfacing lever posts include a rounded or radial top surface 71 that interfaces with the top round surface of spherical bulb 63 on lever 62.

Cord grip material 70 may be in the form of an insert that may be stuck onto the inner wall of clamp ring 58 via catch posts (not visible) to hold it in place within the clamp ring. In one implementation, material 70 may be glued permanently to the inner wall of clamp ring 58.

Figure 24:
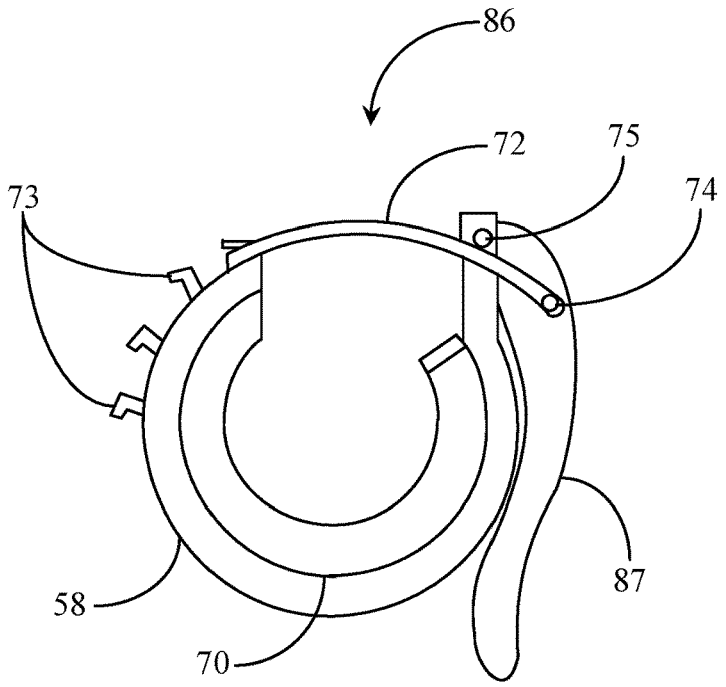
FIG. 24 is an end view of a grip adjustable cord clamp set to a minimum grip state according to another embodiment of the present invention.
Figure 25:
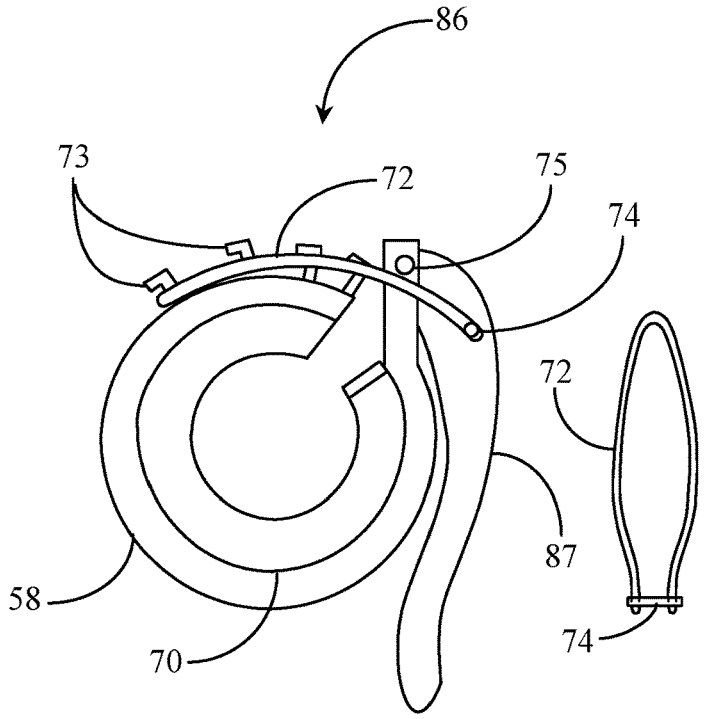
FIG. 25 is an end view of the cord clamp of FIG. 24 set to a maximum grip state.

FIG. 24 is an end view of a grip-adjustable cam clamp 86 set to a minimum grip state according to an embodiment of the present invention. Cam clamp 86 utilizes a catch ring 72 in place of a clamp cross bar analogous to bar 59 of FIG. 23. FIG. 25 is an end view of cam clamp 86 of FIG. 24 set to a maximum grip state. Referring now to FIG. 25, catch ring 72 is in the form of an elongate ring or hook (overhead depiction) that may be pivotally attached to cam clamp lever 87 via a catch ring hinge pin 74.

Referring to FIG. 24, catch posts 73 may be manufactured of steel pin stock with a hook effect or feature at the catch end of the pin. The mounting end of the pin may be press fit into suitable opening provided in clamp ring. Catch posts 73 may be equally spaced apart in a linear array. There are four catch posts 73 in this example however, there may be fewer or more catch posts provided.

Catch ring 72 may be manufactured of steel wire material or another durable material that may be formed and that may hold a formed shape or profile such as the loop profile of this example. Catch ring 72 may be more or less annular than the elliptical profile depicted here without departing from the spirit and scope of the present invention. Other shapes may be emulated such as rectangular. The only requirement is that the inner portion of the ring be sufficiently wide to clear the width of the catch post array.

In this example, clamp 86 is closed and catch ring 72 is latched onto the most proximal catch post available in the linear array. Cam clamp lever 87 is rotatably attached to mounting posts of main clamp ring 58 via lever hinge pin 75. This is indicative of a minimum setting in adjustment of the clamp for the force needed to close the clamp using lever 87. At this setting the cam lever can be used (minimum force required) to clamp onto a power cord.

FIG. 25 is an end view of cam clamp 86 of FIG. 24 set to a maximum grip state. Clamp 86 is in in a closed state with catch ring 72 hooked onto the most distal catch post 73 in the array. In this position, it requires the most force by the user to open and close the clamp over a power cord. The cam mechanics of the lever and clamp ring (radial surfaces and divot interfaces) reduce the friction and resistance of operating the lever.

In this example, it may be seen that several different diameters of power cords may be clamped on to without requiring an adjustment between opening and closing the cam clamp. In one implementation in place of catch ring hinge pin 74, there may instead be two opposing ring posts that catch ring 72 may mount two at either side of lever 87.

Figure 26:
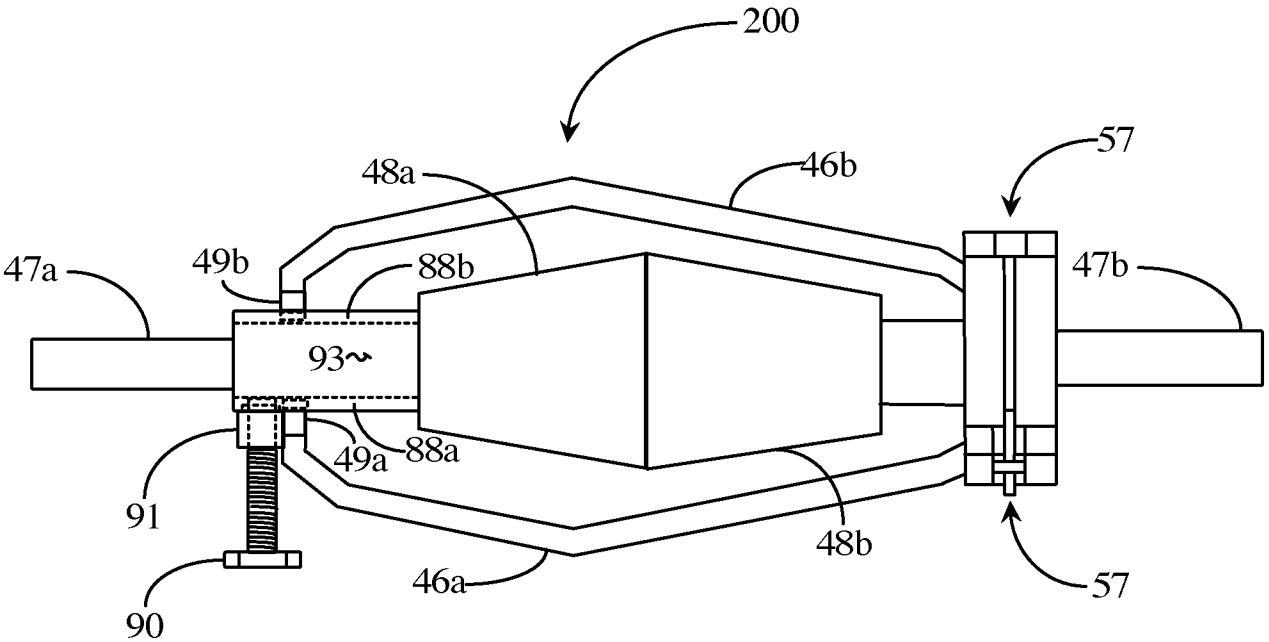
FIG. 26 is an overhead view of a plug and socket securing system according to a further embodiment of the present invention.

FIG. 26 is an overhead view of a plug connection securing apparatus 200 according to a further embodiment of the present invention. Apparatus 200 includes clamp 57. In this view clamp 57 is closed over second power cord 47*b*. In one implementation using clamp 57, the opposite side of apparatus 200 may include a one-piece base cylinder 93. Base cylinder 93 may be somewhat analogous in basic construction to base cylinder 1 of FIG. 3 in this specification with an exception that a stop bolt 90 is provided to stop the cylinder from sliding over the power cord once clamp 57 is in a closed state.

Stop bolt 90 has external threading that may match to internal threading provided in a through bolt housing 91. Housing 91 may be installed onto either track 88*a* or 88*b* in this example to provide the stop function. The width of tracks 88*a* and 88*b* are just larger than the diameter of threaded bolt 90 so the bolt may freely slide through the tracks when the bolt is not tightened against the bottom of the instant track, which is the stop function in this implementation.

Tracks 88*a* and 88*b* might extend the entire length of base cylinder 93 breaking out at both ends of the cylinder. In another embodiment, the tracks may be blind to one side of the cylinder, typically the rear side opposite of plug 48*a*. Base cylinder 93 may be installed over first power cord 47*a* before plug 48*a* is wired to the cord. In another implementation base cylinder 93 may include a longitudinal through slot that enables expansion of the cylinder over the power cord whereby the cylinder springs back to its original diameter once release over the cord.

Base cylinder 93 may be urged to abut against the back face of first plug (male) 48*a* before clamp 57 is pivoted up to power cord 47*b* and closed or clamped over the cord. Once clamp 57 is closed extension bars 46*a* and 46*b* may not slide within tracks 88*a* and 88*b* due to clamp 57 being clamped tightly over power cord 47*b*. In this case, stop bolt through housing 91 may be urged to abut against extension bar 46*a* and extension receptacle 49*a*. Without stop bolt 90 cylinder 93 may slide away from the back face of plug 48*a*. A user may hold base cylinder 93 against the back face of plug 48*a* and allowing the ends of first bar 46*a* and second bar 46*b* to rest in the tracks at that position. To then stop the cylinder from separating from the plug, the stop bolt may be tightened against the track bottom to function more as a cylinder stop to keep it in position against the back of plug 48*a*.

In use of this embodiment of the invention, a user may first slide base cylinder 93 up against the back faces of first plug 48*a*. The user may then connect second plug 48*b* to the first plug. The user may then swing the extension bars along with attached cam clamp 57 up and into position to clamp over the second power cord while maintaining the position of cylinder 93 against the back face of plug 48*a* physically. Once clamp 57 is closed, the user may slide bolt housing 91 up to and adjacent to first extension bar 46*a* and tighten bolt 90 against the bottom surface of track 88*a* thereby locking the base cylinder into place relative to the reward position of the extension bars and preventing any slippage.

It is apparent to one with skill in the art that base cylinder 93 does not actually clamp to first power cord 47*a* and that the cylinder is prevented from separating from its abutment against plug 48*a* only by the stop bolt assembly. In one embodiment, there may be two stop bolts 90 including accompanying hardware with one assembly on each track without departing from the spirit and scope of the present invention. In still another embodiment there may be two cam clamps 57 a forward clamp and a reward clamp without departing from the spirit and scope of the present invention.

Figure 27:
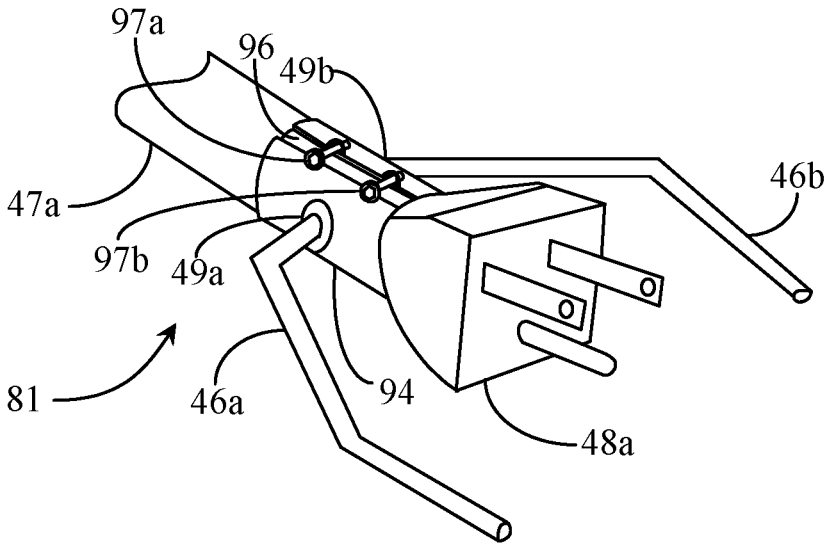
FIG. 27 is a partial perspective view depicting a base cord clamp for a plug and socket securing system according to a further embodiment of the present invention.

FIG. 27 is a partial perspective view depicting a base cord clamp 81 for a plug and socket securing system according to a further embodiment of the present invention. Base cord clamp 81 may be similar in some respects to base cylinder 1 described relative to FIG. 14 included above in this specification with a few exceptions one of which is that there are no tracks or groves required and a larger width cutout 96 is provided to enable aftermarket installation over power cord 47*a*. In this implementation base clamp cylinder 94 has extension bar receptacles 49*a* and 49*b* located in a fixed position on the cylinder body and therefore do not side but may allow the ends of bars 46*a* and 46*b* to pivot freely.

It may be assumed that a cam clamp such as clamp 57 is connected at the distal side of the overall apparatus (not shown). In one embodiment, base clamp 81 may be installed before plug 45*a* is added. Plug 48*a* is depicted with a top plate 82 removed by loosening clamp screws 95*a* and 95*b*. In this way, base clamp cylinder 94 may be installed and then the user may install plug 48*a* by removing the top for inside access to wiring locations for hot wire, ground wire, and a neutral wire (dotted line depiction).

Base clamp cylinder 94 may be tightened around power cord 47*a* using first clamp screw 97*a* and second clamp screw 97*b*. There may be one clamp screw or more than one clamp screw provided to close clamp cylinder 94 without departing from the spirit and scope of the invention. In general use of the invention in this embodiment, a user may install clamp cylinder 94 onto power cord 47*a*. In the case of before market manufacturing, the user may then install (wiring) plug 48*a* to power cord 47*a* via removal of plate 82 followed by wiring the correct connections together within the plug body.

Figure 28:
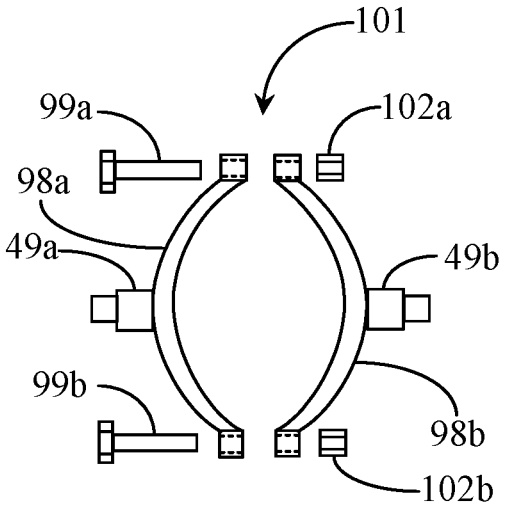
FIG. 28 is a right end view of a two-piece base cord clamp according to another embodiment of the present invention.

FIG. 28 is a right end view of a two-piece base cord clamp 101 as an alternative embodiment to cut base clamp cylinder 94 of FIG. 27. Cord clamp 101 includes a first half cylinder 98*a* and a second half cylinder 98*b*. Half cylinders 98*a* and 98*b* may be manufactured of a steel or other metals or of a durable polymer material. Extension bars are not illustrated in this view but may be assumed present and connected to receptacles 49*a* and 49*b* as in FIG. 27. In this implementation bolts 99*a* and 99*b* along with nuts 102*a* and 102*b* may be used to clamp the two halves over a power cord.

In one implementation, there may be more than two screws and nuts provided for clamping the two halves together over a power cord. For example, four screws and nuts with two side-by-side on the top and two side-by-side at the bottom. The actual profile of half cylinders 98*a* and 98*b* are less than half round such that cord clamp 101 may be used on a variety of different diameter power cords. The inside surfaces of half cylinders 98*a* and 98*b* may be coated with a rubber or other non-frictional material for improving grip on the power cord without damaging the cord.

It will be apparent to one with skill in the art that there may be variant architectures and hardware additions that may be provided to the base cord clamp assembly without departing from the spirit and scope of the present invention, such as provision of gaskets or grommets to accommodate power cords of varying sizes. In one embodiment, a ring gasket might be provided with a hose clamp device to constrict the ring gasket down onto the power cord adjacently to a base cylinder, for example.

Figure 29:
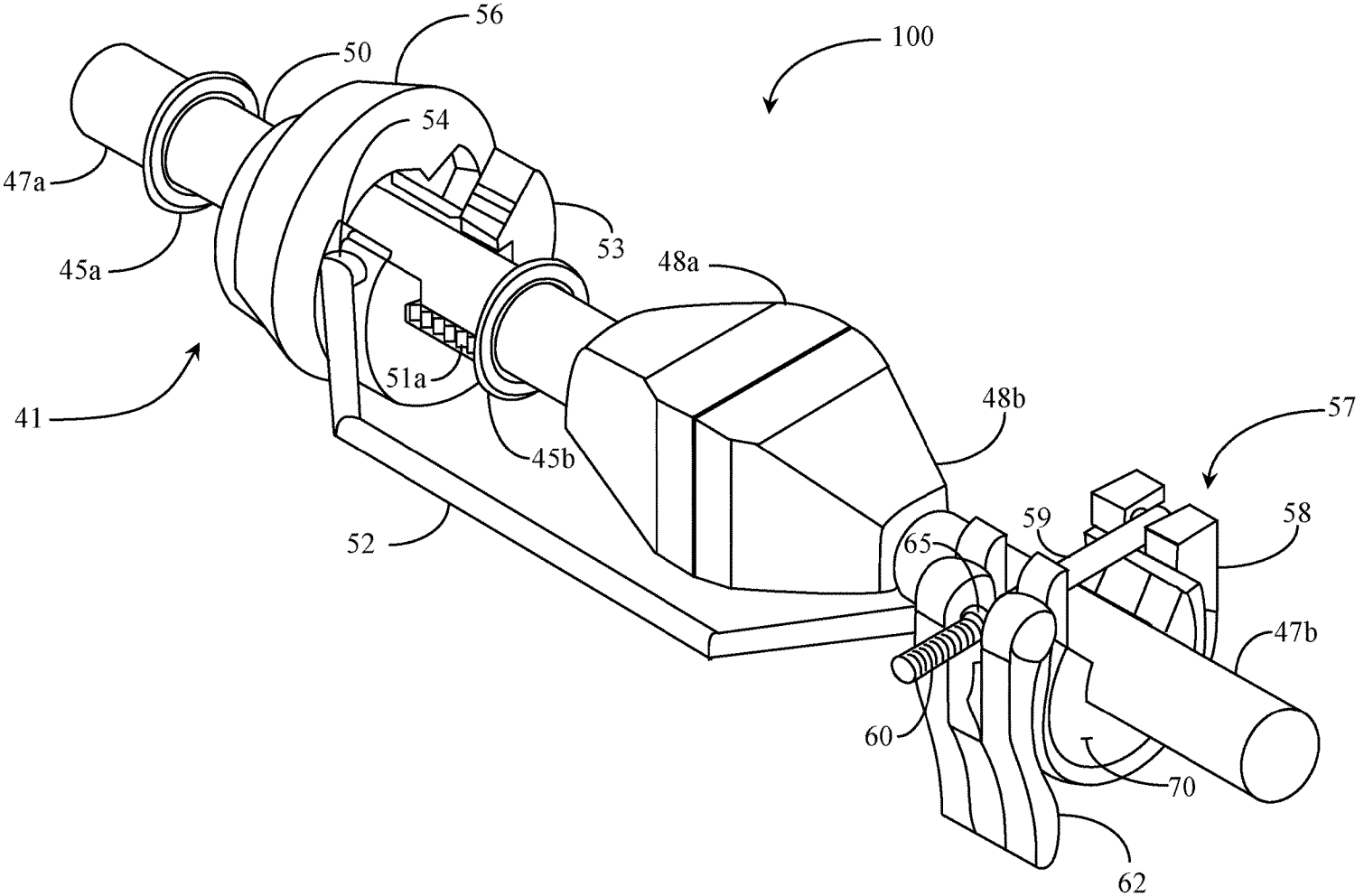
FIG. 29 is a perspective view of a plug clamp system according to an embodiment of the present invention.

FIG. 29 is a perspective view of a plug connection securing clamp system 100 according to an embodiment similar to that shown in FIG. 17. Assembly 41 and assembly 57 are connected by a first extension bar 52, only. This description does not preclude other arrangements of clamps and bases implementing a single extension bar. For example, assembly 41 may be connected via at least one extension bar to assembly 57 or base 81 of FIG. 27 or cord clamp 101 of FIG. 28, or even a clamp as depicted in FIGS. 24-25. Virtually any arrangement between any of the clamps and bases disclosed in the present invention may be connected by one or two extension bars.

It will be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the hardware may be implemented within the scope of the invention. The invention is limited only by the breadth of the claims below.

The invention claimed is:

1. An electrical connection secure clamp system, comprising:

a cylindrical base having a length and a diameter securely connected around a first electrical cord including at least one linear tooth array on an outside surface of the base, aligned with a longitudinal center of the base and a locking assembly, comprising;

an open ended cylindrical jacket installed over the base by fitting the base into a cutout in the jacket, the jacket tapered in a direction of the first power cord, the jacket having at least one groove on an inside surface accommodating one or more complimentary teeth arranged parallel with and opposite to the linear tooth array;

a threaded nut having threads on an inner surface matching threads on an outer surface of the jacket;

at least one extension bar, one end rotatably attached to a receptacle on one side of the jacket and a distal end extending past a first connector and a second connector, enabled to securely attach to a clamp secured around a second power cord attached to the second connector;

wherein locking the connectors in an engaged position the thread nut moves up the threads of the jacket towards the first connector creating pressure enabling engagement between the linear tooth array and the one or more complimentary teeth, thereby locking the jacket in place, or disengaging the distal end from the clamp, enabling translation of the extension bar allowing disengagement of the connectors from an engaged position.

2. The system of claim 1, wherein an additional extension bar is attached at a second receptacle on an opposing side of the jacket, the additional extension bar enabled to fixedly attach to the fixed half of the clamp.

3. The system of claim 1, wherein the clamp includes a moveable half and a fixed half fabricated from a tensile material, the fixed half forming a semi-circle, the at least one extension bar connecting to the fixed half, and wherein the moveable half connects to the fixed half via a hinge at the first end and a lock and release at the second end, wherein the moveable half lifts off of the fixed half from the second end creating an opening to receive the second power cord enabling the moveable half to close on the second power cord and lock.

4. The system of claim 3, wherein the moveable half consists of a clamp bar, the clamp bar including a distal threaded end incorporating a threaded nut enabled to translate up and down the threaded end, the threaded nut having two opposing pins that engage opposing pin receptacles at two spherical ends of a lever enabling the lever to rotate about the pins and translate up and down the threads at the threaded end thereby enabling accommodation of different sized second power cords.

5. The system of claim 4, wherein the fixed half includes two divots at an outside edge of the semi-circle below the second end, positioned to accept the spherical ends of the lever in a closed position and the pin receptacles are offset from a center of the two spherical ends away from a surface of the two spherical ends that engage the divots, wherein as the lever is pulled down in a closed position against the fixed half, an amount of pressure against the divots increases reaching a maximum amount of pressure immediately before the clamp is fully closed decreasing the distance between the first end and the second end of the fixed half thereby securely locking the clamp bar in place over the second power cord.

6. The system of claim 3, wherein the moveable half comprises a loop having two ends attached, one end each, at opposing sides of a lever connected to the second end of the fixed half.

7. The system of claim 6, wherein the loop is enabled to engage one of a plurality of catch posts fixedly attached to the outside edge of the fixed half thereby replacing position of the divots, wherein when the loop is engaged with one of the anchors, the lever is pushed down applying a maximum amount of pressure against the power cord immediately prior to the lever closing in a locked position, thereby decreasing a dimension of the fixed half.

8. The system of claim 7, wherein the catch posts are positioned in a linear array and selection of an catch post to engage the loop defines a size of power cord that is secured within the fixed half.

9. An electrical connection secure clamp system, comprising:

a clamp including a fixed half and a moveable half fabricated from a tensile material consisting of a clamp bar, the clamp bar including a distal threaded end incorporating a threaded nut, the fixed half forming a semi-circle creating an opening for accepting a first power cord next to a first electrical connector, the moveable half connecting to the fixed half via a hinge at one upper end of the opening and a lock and release at a second upper end opposing the one upper end;

at least one extension bar having one bar end fixedly connected to one side of the fixed half and a second distal bar end extending past a second electrical connector and rotatably attached to a receptacle on one of two opposing sides of a base surrounding a second power cord connected to the second electrical connector;

wherein the moveable half lifts off of the fixed half from the second end creating an opening to receive the second power cord enabling the moveable half to close on the second power cord and the threaded nut is enabled to translate up and down the threaded end, the threaded nut having two opposing pins that engage opposing pin receptacles at two spherical ends of a lever enabling the lever to rotate about the pins and translate up and down the threads at the threaded end thereby enabling accommodation of different sized second power cords.

10. The system of claim 9, wherein a second extension bar is rotatably attached at a second distal end to a second one of the two opposing sides and fixedly attached at a second bar end at a second side of the fixed half opposite the one side.

11. The system of claim 9, wherein the fixed half includes two divots at an outside edge of the semi-circle below the second end, positioned to accept the spherical ends of the lever in a closed position and the pin receptacles are offset from a center of the two spherical ends away from a surface of the two spherical ends that engage the divots, wherein as the lever is pulled down in a closed position against the fixed half, an amount of pressure against the divots increases reaching a maximum amount of pressure immediately before the clamp is fully closed decreasing the distance between the first end and the second end of the fixed half thereby securely locking the clamp bar in place over the second power cord.

12. The system of claim 9, wherein the base is comprised of two equal opposing sides with means to connect together around the second power cord forming a cylinder base.

13. The system of claim 12, wherein the two equal opposing sides are ellipses and include means for connection to each other forming the base enabling tightening of the two sides around a variety of power cords having a smaller circumference than the base.

14. An electrical connection secure clamp system, comprising:

a clamp including a fixed half fabricated from a tensile material, the fixed half forming a semi-circle creating an opening for accepting a power cord next to a first connector;

a loop having two ends attached, one end each at opposing sides of a lever connected to the fixed half via a hinge;

an extension bar fixedly attached to the fixed half having a distal end extending past the first connector and a second connector rotatably attaching to a base securing a second power cord connected to the second connector.

15. The system of claim 14, wherein the loop is enabled to engage one of a plurality of catch posts fixedly attached to an outside edge of the fixed half below the second end, wherein when the loop is engaged with one of the catch posts, the lever is pushed down applying a maximum amount of pressure against the power cord immediately prior to the lever closing in a locked position thereby decreasing a dimension between the fixed half.

16. The system of claim 15, wherein the catch posts are positioned in a linear array and selection of an catch post to engage the loop defines a size of power cord that is secured within the fixed half.

17. The system of claim 14, wherein the base is comprised of two equal opposing sides with means to connect together around the second power cord forming a cylinder base.

18. The system of claim 17, wherein the two equal opposing sides are ellipses and include means for connection to each other forming the base enabling tightening of the two sides around a variety of power cords having a smaller circumference than the base.

* * * * *